US006084351A

United States Patent [19]

Kai et al.

[11] Patent Number: 6,084,351

[45] Date of Patent: Jul. 4, 2000

[54] METAL HALIDE LAMP AND TEMPERATURE CONTROL SYSTEM THEREFOR

[75] Inventors: Makoto Kai, Yawata; Yuriko Kaneko, Nara; Mamoru Takeda, Souraku-gun, all of Japan

[73] Assignee: Matsushita Electric Industrial Co., Ltd., Osaka-fu, Japan

[21] Appl. No.: 08/923,421

[22] Filed: Sep. 4, 1997

[30] Foreign Application Priority Data

Sep. 6, 1996 [JP] Japan ..... 8-236350
Mar. 17, 1997 [JP] Japan ..... 9-062660

[51] Int. Cl.[7] ..... H01J 17/16; H01J 61/30; H01J 17/20; H01J 61/12

[52] U.S. Cl. ..... 313/634; 313/570; 313/571; 313/620; 313/642

[58] Field of Search ..... 313/44, 493, 570, 313/571, 634, 637, 638, 639–41, 642, 643, 620, 621, 605, 606, 10–11, 13, 17–19, 28; 315/147, 317, 324, 116, 115, 112, 50, 117

[56] References Cited

U.S. PATENT DOCUMENTS

| | | | |
|---|---|---|---|
| 3,927,343 | 12/1975 | Beijer et al. . | |
| 4,161,672 | 7/1979 | Cap et al. | 313/620 X |
| 4,468,590 | 8/1984 | Akutsu et al. | 313/634 X |
| 4,672,267 | 6/1987 | Lapatovich et al. | 313/571 |
| 5,138,228 | 8/1992 | Thomas et al. | 313/634 |
| 5,189,340 | 2/1993 | Ikeda | 313/13 X |
| 5,210,463 | 5/1993 | Fromm et al. . | |
| 5,239,230 | 8/1993 | Mathews et al. | 313/620 X |
| 5,402,037 | 3/1995 | Irisawa et al. | 313/637 X |
| 5,416,383 | 5/1995 | Genz | 313/634 |
| 5,481,159 | 1/1996 | Hiramoto et al. | 313/637 X |
| 5,486,737 | 1/1996 | Hrubowchak et al. | 313/634 |
| 5,497,049 | 3/1996 | Fischer | 313/634 |
| 5,677,598 | 10/1997 | De Hair et al. | 313/493 X |
| 5,723,943 | 3/1998 | Brooker et al. | 313/594 X |

FOREIGN PATENT DOCUMENTS

| | | |
|---|---|---|
| 0 209 345 A2 | 1/1987 | European Pat. Off. . |
| 0 258 829 A2 | 3/1988 | European Pat. Off. . |
| 0 459 786 A2 | 12/1991 | European Pat. Off. . |
| 0 649 164 A2 | 4/1995 | European Pat. Off. . |
| 0 714 118 A1 | 5/1996 | European Pat. Off. . |
| 35 19 627 | 12/1986 | Germany . |
| 2 294 580 | 5/1996 | United Kingdom . |

*Primary Examiner*—Sandra O'Shea
*Assistant Examiner*—Mack Haynes
*Attorney, Agent, or Firm*—Wenderoth, Lind & Ponack, L.L.P.

[57] ABSTRACT

In a metal halide lamp which includes a discharge tube (2) retaining a fill of mercury and at least one metal halide added as a luminous material, an energy density of the arc discharge portion (3) represented by a product E×j is in the range of 70.0≦E×j≦150.0 (VA/mm$^3$) where E=V/d, j=I/S, assuming that I is a lamp current in amperes with a lamp voltage of V volts applied between the paired discharge electrodes in a stable lighting condition of the lamp and that each of the electrodes has a tip face (1*a*, 1*a*') of which a cut area in section is S mm$^2$ and the gap distance is d in millimeters, and thus a high luminous flux retention rate and high luminance of an arc discharge portion can be accomplished with a longer life of the lamp, suppressing a lamp voltage varying rate, and avoiding a change in color temperature, which remarkably improves additional merits when in utilization as a light source in various display apparatuses such as optical projection systems.

20 Claims, 17 Drawing Sheets

(m : mass of filled Mercury)

○ Sealed Metal A, Lamp Power 200W
◇ Sealed Metal B, Lamp Power 200W
◆ Sealed Metal C, Lamp Power 150W
Tm(K)
4000
3500
3000
2500
2000
1500
0
50
100
150
200
250
300
350
E×j [V·A/mm³]

⊙ Sealed Metal A, Lamp Power 200W
◇ Sealed Metal B, Lamp Power 200W
◆ Sealed Metal C, Lamp Power 150W
L.F.R.(%)
100
95
90
85
80
75
70
2000
2500
3000
3500
Tm(K)

METAL HALIDE LAMP AND TEMPERATURE CONTROL SYSTEM THEREFOR

BACKGROUND OF THE INVENTION

1. Field of the Invention

The present invention generally relates to a low-power, high-pressure discharge lamp, and in particular to a metal halide lamp having a discharge envelope vessel retaining a metal halide fill in a mercury atmosphere, and to a temperature control system for maintaining a stable lighting condition of the lamp, and maintaining a high luminous flux retention rate of the lamp.

2. Description of the Prior Art

Conventionally, a metal halide lamp has been fabricated under consideration of various quantitative restrictions such as restriction on lamp power consumption required for sufficient luminous energy or quantity of light in view of the provision of a lighting circuit, and in particular, when a lamp is used as a light source in an optical projector system, there have been required further restrictions such as a gap distance or an arc length between a pair of discharge electrodes. The electrodes, which are made of tungsten and the like material, are fabricated in a specific shape and size for increasing a luminance or brightness of an arc discharge portion to be produced between the electrodes in view of an optical requirement and an upper limit in quantity of a fill of mercury restricted for ensuring a pressure-proof property of an arc discharge tube.

Moreover, in recent years, there has been an increasingly strong demand for developing a metal halide lamp for use as a light source having characteristics of high luminance and high luminous flux retention rate in an essential part of an optical display incorporated in e.g. an optical projection system.

In particular, it is essentially important to optimize a contour of the discharge electrodes per se having a specific shape and dimension in fabricating a metal halide lamp because the design thereof exerts a great influence on the characteristics of the lamp such as a luminous flux retention rate, luminance of the arc discharge portion and lamp voltage varying rate.

However, in the conventional manufacturing method of the lamp, there has not been yet taught or established a guiding principle for providing a suitable design of electrodes to have optimum lamp characteristics, i.e., high luminous flux retention rate, high luminance of the arc discharge portion and small lamp voltage varying rate, under consideration of the restrictions of the lamp power, gap distance between electrodes, and upper limit of the fill of mercury. Therefore, the fabrication of an optimum metal halide lamp has been mainly carried out by reliance on experience.

In this conventional metal halide lamp, there have been drawbacks that, the discharge tube wall of quartz glass is easily reactive with a metal halide at a high temperature of about 1100° C. or higher, and if the quantity of the metal halide sealed inside the tube is reduced by the reaction with the glass tube wall, the luminous flux retention rate is undesirably reduced to deteriorate the life property of the lamp.

Moreover, there have been problems that flickers and darkening phenomenon in the discharge tube wall may be easily caused undesirably due to scattering of the electrode evaporation to be adhered onto the inner face of the discharge tube during the light-on operation of the lamp, and also a color temperature change may be easily caused due to the change of the lamp voltage. The progressing degree of the blackening phenomenon is deeply related to the contour design of the electrodes.

When the heating of the discharge tube is excessively suppressed in temperature, there may be undesirably caused a lower-most part in temperature in the discharge tube wall behind the electrodes, which suppresses the evaporation of the metal halide in the discharge tube, resulting in deterioration of the luminous efficiency.

Thus, there has been an increasingly strong demand for establishing a reference guiding principle for providing a suitable design of discharge electrodes to have optimum lamp characteristics, i.e., high luminous flux retention rate, high luminance of the arc discharge portion and small lamp voltage varying rate in fabricating a metal halide lamp, under consideration of the restrictions of the lamp power, gap distance between the electrodes, and upper limit in mass of the fill of mercury.

SUMMARY OF THE INVENTION

Accordingly, in view of the above-described problems, the present inventors have studied specific mutual relations when fabricating a metal halide lamp under consideration of restrictions of a lamp power, gap distance between oppositely disposed discharge electrodes, and upper limit of a fill of mercury. In summary, the present inventors have found that a product between a lamp electric field and a current density has mutual relations to a luminous flux retention rate and to a mean temperature value at a tip portion of each electrode where the lamp electric field and current density respectively depend on a gap distance between the oppositely disposed electrodes and the shape and size of the electrodes.

Based on the inventors' study mentioned above, they have developed a novel method for fabricating an improved metal halide lamp having optimum lamp characteristics, i.e., high luminous flux retention rate and high luminance of the arc discharge portion.

Moreover, the present inventors have studied and found a mutual relation between the shape and dimension of the electrodes and the lamp voltage varying rate, and found a mutual relation between the lamp electric field and the lower-most temperature of the discharge tube wall.

Thus, an essential objective of the present invention is to provide an improved metal halide lamp having a high luminous flux retention rate and high luminance of an arc discharge portion, suppressing a lamp voltage varying rate.

Another objective of the present invention is to provide a temperature control system for the improved metal halide lamp.

In order to achieve the objectives mentioned above, a first inventive metal halide lamp which includes a discharge tube retaining a fill of mercury and at least one metal halide added as a luminous material in an inert gas atmosphere sealed therein, comprises: a pair of discharge electrodes oppositely disposed with a space of a gap distance defining a length of an arc discharge portion produced between the paired discharge electrodes in the discharge tube, where an energy density of the arc discharge portion represented by a product $E \times j$ is in the range of $70.0 \leqq E \times j \leqq 150.0$ (VA/mm$^3$) where $E=V/d$, $j=I/S$, assuming that I is a lamp current in amperes with a lamp voltage of V volts applied between the paired discharge electrodes in a stable lighting condition of the lamp and that each of the electrodes has a tip face (1*a*, 1*a*')

of which a cut area in section is S $mm^2$ and the gap distance is d in millimeters.

In a second inventive metal halide lamp, a temperature mean value (Tm) of an electrode tip portion of each electrode is set within the range of 2300 to 2700 K.

In a third inventive metal halide lamp, a relation between an electric field (Em) per unit mass of the mercury fill and the current density (j) is represented by a linear line having a certain inclination, and the current density (j) is restricted within a range represented by a formula:

$$j=30.5\times Em+a$$

where "a" is a parameter in the range of $-14.0 \leqq a \leqq -13.0$, and Em=V/d/m, and j=I/S.

In a fourth inventive temperature control system for adjusting the temperature of the discharge bulb wall of the metal halide lamp, the system comprises: a temperature control unit for adjusting the temperature of the discharge bulb wall; a lamp voltage detecting unit for detecting the lamp voltage applied to the metal halide lamp; and a calculation control unit receiving a data signal of the lamp voltage value from the lamp voltage detecting unit, and judging whether or not lamp operating points are put on an optimum condition of the lamp, and then transmitting the resultant control signal of the calculation judgement to the temperature control unit for the temperature adjustment.

By this arrangement, an improved metal halide lamp can be provided to have a high luminous flux retention rate and high luminance of an arc discharge portion with a longer life of the lamp, suppressing a lamp voltage varying rate, and avoiding a change in color temperature, which remarkably improves additional merits when in utilization as a light source in various display apparatuses such as optical projection systems.

Moreover, the optimum range of the temperature mean value of the electrode tip portion can be defined with a fixed value of E×j (=V/d×I/S), with the fixed values of gap distance (d) and area (S) in section of the electrode tip portion.

In the construction of the present invention, a wide range of different metal halide materials to be sealed as well as different lamp powers can be adapted to fabricating metal halide lamps, and therefore the degree of freedom in fabrication of the design and efficiency in development thereof can be remarkably improved.

Moreover, in arranging a lamp-lighting circuit, since the securing range in applying the lamp voltage can be restricted, the fabrication in design of the lamp can be facilitated advantageously.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Figure 1:
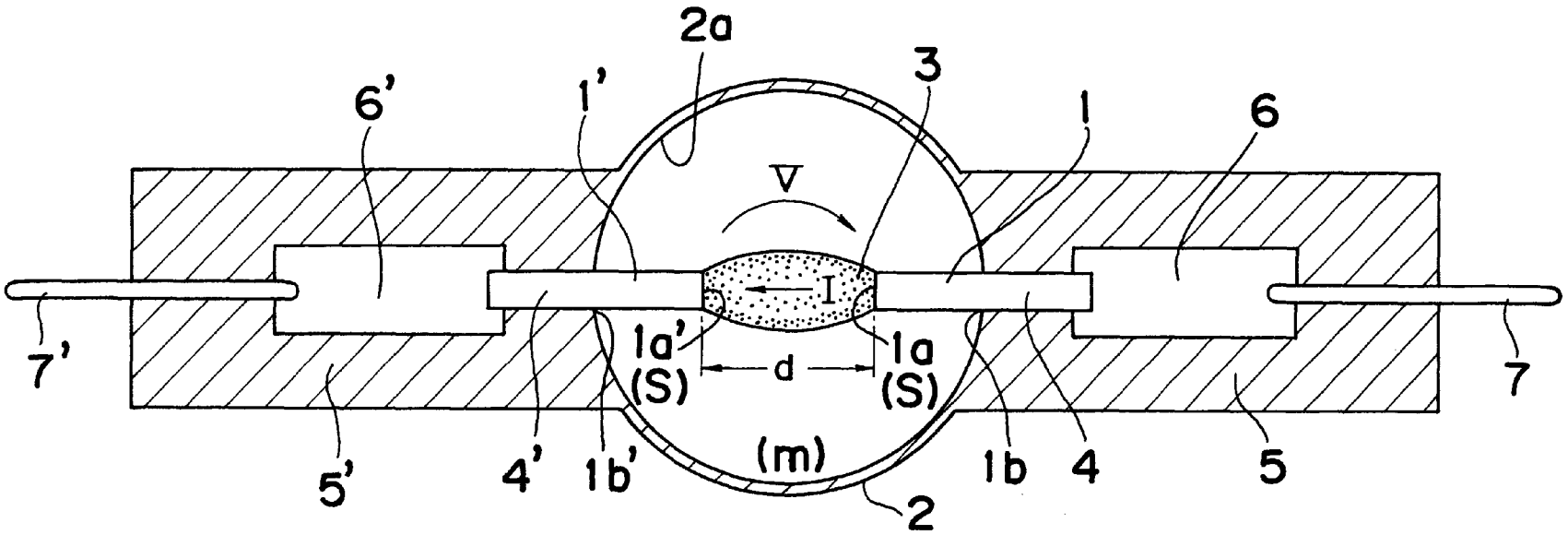
FIG. 1 is a schematic plan view showing a metal halide lamp of a first embodiment according to the present invention.

Before the description proceeds, it is noted that, since the basic structures of the metal halide lamps are the same in the preferred embodiments, like parts are designated by like reference numerals in the appending drawings.

First Embodiment

The following describes a first embodiment of the present invention with reference to FIGS. 1 to 6.

FIG. 1 shows a schematic construction of a metal halide lamp which includes a discharge tube 2 serving as a discharge envelope vessel made of e.g. a quartz glass or the like material, having a spherical-like inner bulb wall 2*a* retaining a fill of mercury and at least one metal halide added as a luminous material to obtain a color temperature in an inert gas atmosphere sealed therein.

In the discharge tube 2, a pair of discharge electrodes 1 and 1' made of e.g. a tungsten material are oppositely disposed with a gap therebetween of distance d mm which defines an arc discharge length (d). Each of the electrodes 1 and 1' of a column-like pin shape has a tip face (1*a*, 1*a'*) of which a cut area in section is S $mm^2$ and the paired electrodes 1 and 1' are integrally connected to electrode shafts 4 and 4' respectively and protruded inward therefrom. The electrode shafts 4 and 4' inserted in sealing members 5 and 5' are connected to outer well terminals 7 and 7' respectively via metal foil portions 6 and 6' which are securely sealed in the sealing members 5 and 5'.

Figure 17:
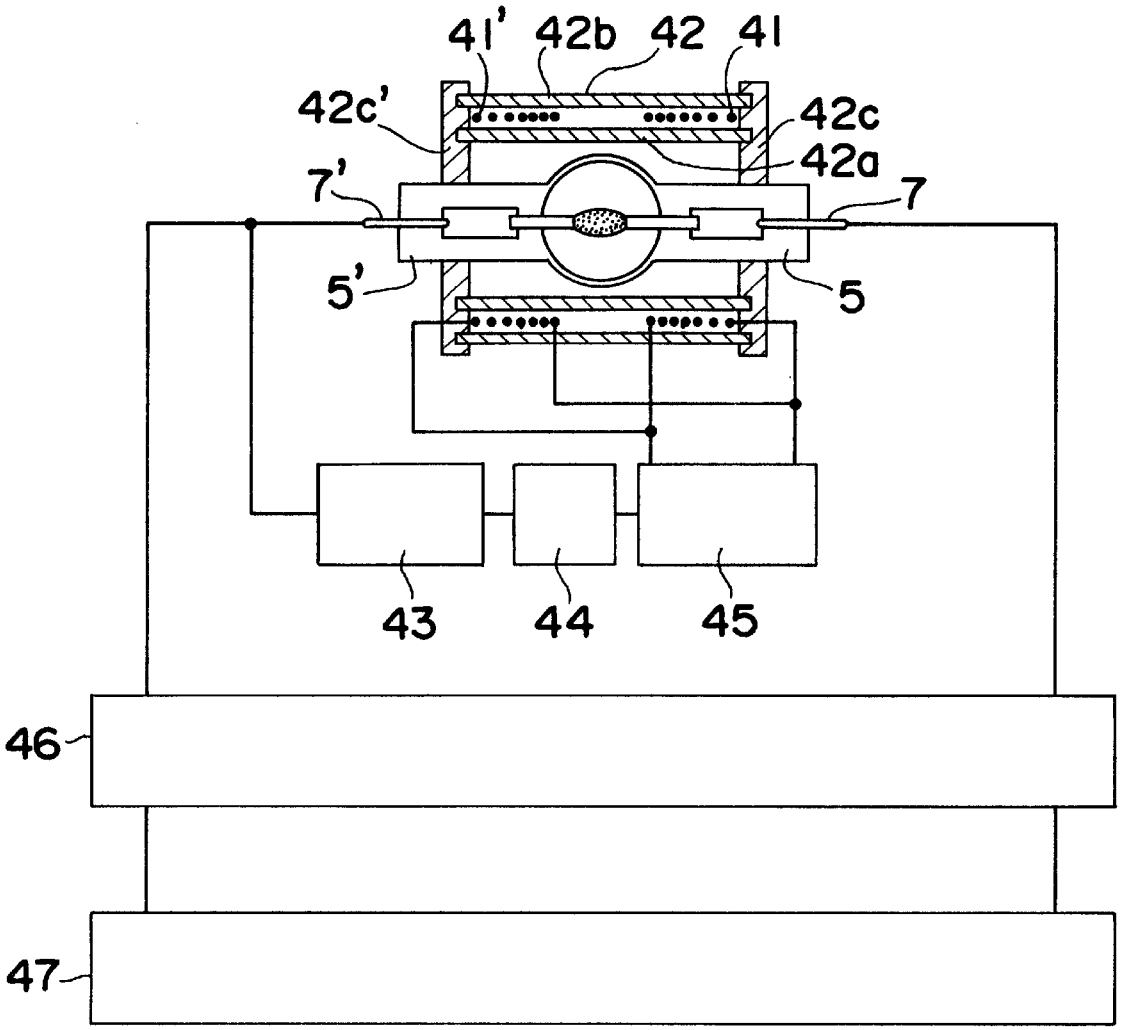
FIG. 17 is a schematic block view showing a construction of a metal halide lamp adjusting system according to the fourth embodiment of the present invention.

In this construction, a lamp voltage (V) is applied between the paired discharge electrodes 1 and 1' to pass a lamp current (I) between the electrodes with use of an arc discharge generating circuit of a power source (as shown in FIG. 17 to be described later), and thus an arc discharge 3 is thereby generated between the electrodes 1 and 1' in the inert gas atmosphere in a stable lighting condition of the lamp.

Now that, by combining various conditions of metal halide lamps varying the gap distance d and tip cut area S within the ranges of: d=1.8 to 13 mm and S=0.169 to 1.327 $mm^2$ (i.e., varying a diameter $\phi$ of a circular cut plane in section of the tip portion of the electrode in the range of $\phi$=0.5 to 1.3 mm), the variation of the luminous flux retention rate was measured using a light-flux meter at a time $t_{100}$ after a time lapse of 100 hours with respect to that at a light start-up time $t_0$ of the lamp while employing different kinds of metal halide materials and different lamp powers.

Figure 2:
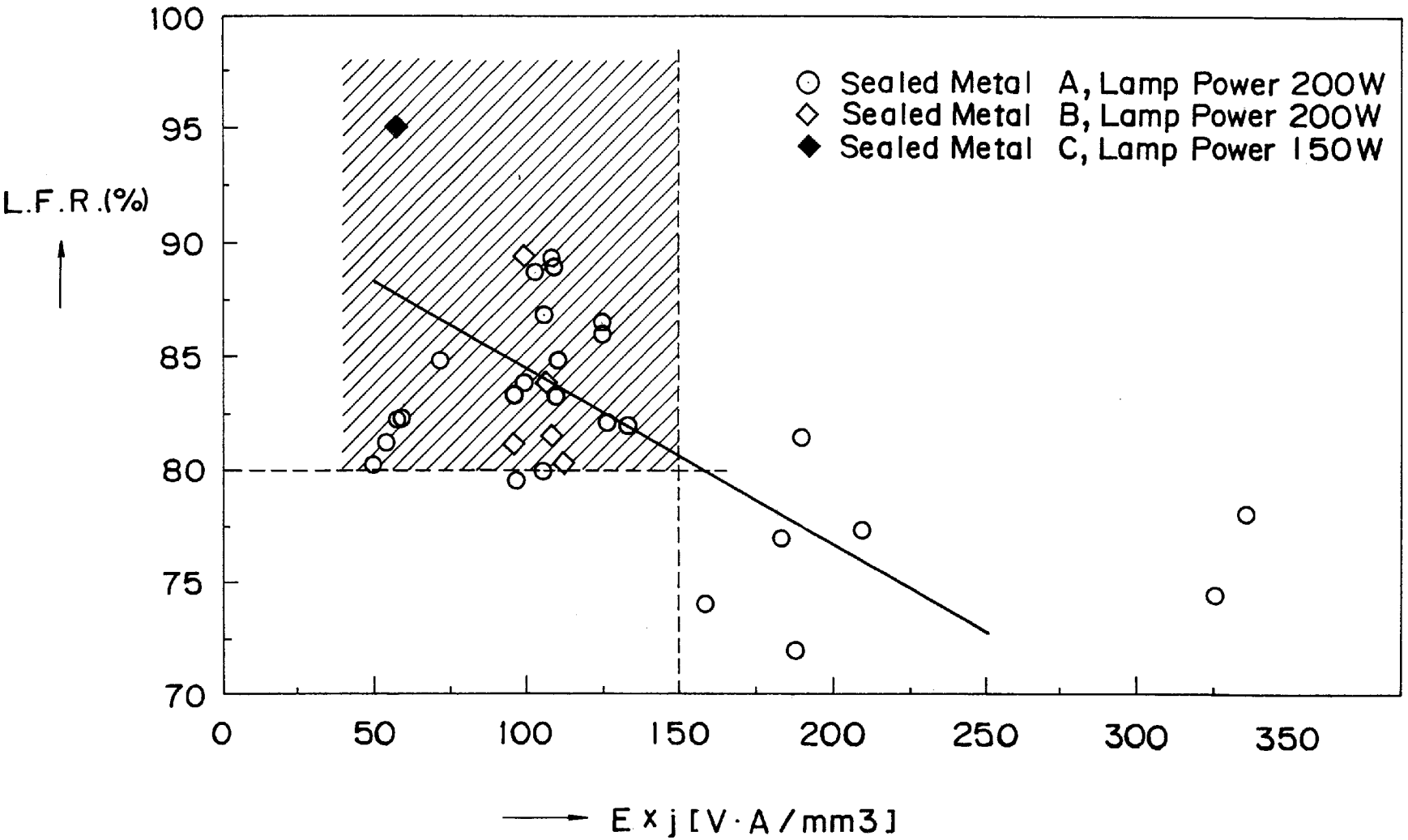
FIG. 2 is a graph showing a relation between a product E×j and a luminous flux retention rate L.F.R. according to the present invention.

FIG. 2 shows a variation of the luminous flux retention rate (%) on an ordinate axis of the graph at a time $t_{100}$ after a time lapse of 100 hours from the light start-up time $t_0$ in relation to a product value (E×j) of a lamp electric field (E) and an electric current density (j) on an abscissa axis after a time lapse of 0 hours, i.e., at a light start-up time $t_0$, where the lamp electric field is represented by: E=V/d (V/mm) and the current density is represented by: j=I/S ($A/mm^2$).

The reason why the luminous flux retention rate is taken after the time lapse of 100 hours is because the deterioration of the luminous flux retention rate is mainly caused by attenuation of a light transmission of the discharge bulb glass due to the blackened or darkish inner wall 2*a* thereof. This blackening phenomenon of the discharge bulb wall 2*a* is caused when the electrode material is vapored and scattered therearound to be adhered onto the inner face 2*a* of the discharge tube 2 during the light-on operation of the lamp. The progressing degree of the blackening phenomenon is deeply related to the contour design of the electrodes.

In FIG. 2, the measurement examples of the experiments are classified into three groups i) to iii) by changing the material of the metal halide fill and lamp power level as below:

i) marks ○ represent a case when using a metal halide fill of indium (In)-holmium (Ho) with lamp power application of 200 W, ii) marks ◇ represent a case when using a metal halide fill of indium (In)-thulium (Tm) with lamp power application of 200 W, and iii) a mark ◆ represents a case when using a metal halide fill of dysprosium (Dy)-thallium (Tl)-sodium (Na)-holmium (Ho)-thulium (Tm) with lamp power application of 150 W, which is available on the market.

In these examples, the measurement was carried out while the gap distance d between the paired electrodes and the area S in section of the tip portion of each electrode are both optionally changed and combined within the ranges mentioned above.

The unit of the product E×j is $V \cdot A/mm^3$, i.e., $W/mm/mm^2$, and this means an energy density per unit length of an arc discharge portion 3 which is received by a unit area of the tip face (1*a*, 1*a'*) of the electrode end portion (1, 1'). It is noted here that a linear solid line in this graph is a regression line $Rl_1$ obtained by a least square approximation of the plots on the graph.

As the measurement results in FIG. 2, the larger the energy density E×j, the worse the luminous flux retention rate is reduced.

This is because, when the energy density E×j is increased, the movement of the energy from the arc discharge portion to each discharge electrode is increased particularly at a front face of the tip portion of the electrode, and therefore the temperature of the electrode tip portion is excessively raised, resulting in the electrode material being vapored, or it may be considered that photons, electrons and the like ions with some particle-like characteristics of high energy density impinge upon the electrode tip portion to thereby cause scattering of the electrode material, resulting in progressing the blackening of the inner face of the discharge bulb wall 2*a*. Thus, the luminous flux retention rate is deteriorated.

Figure 3:
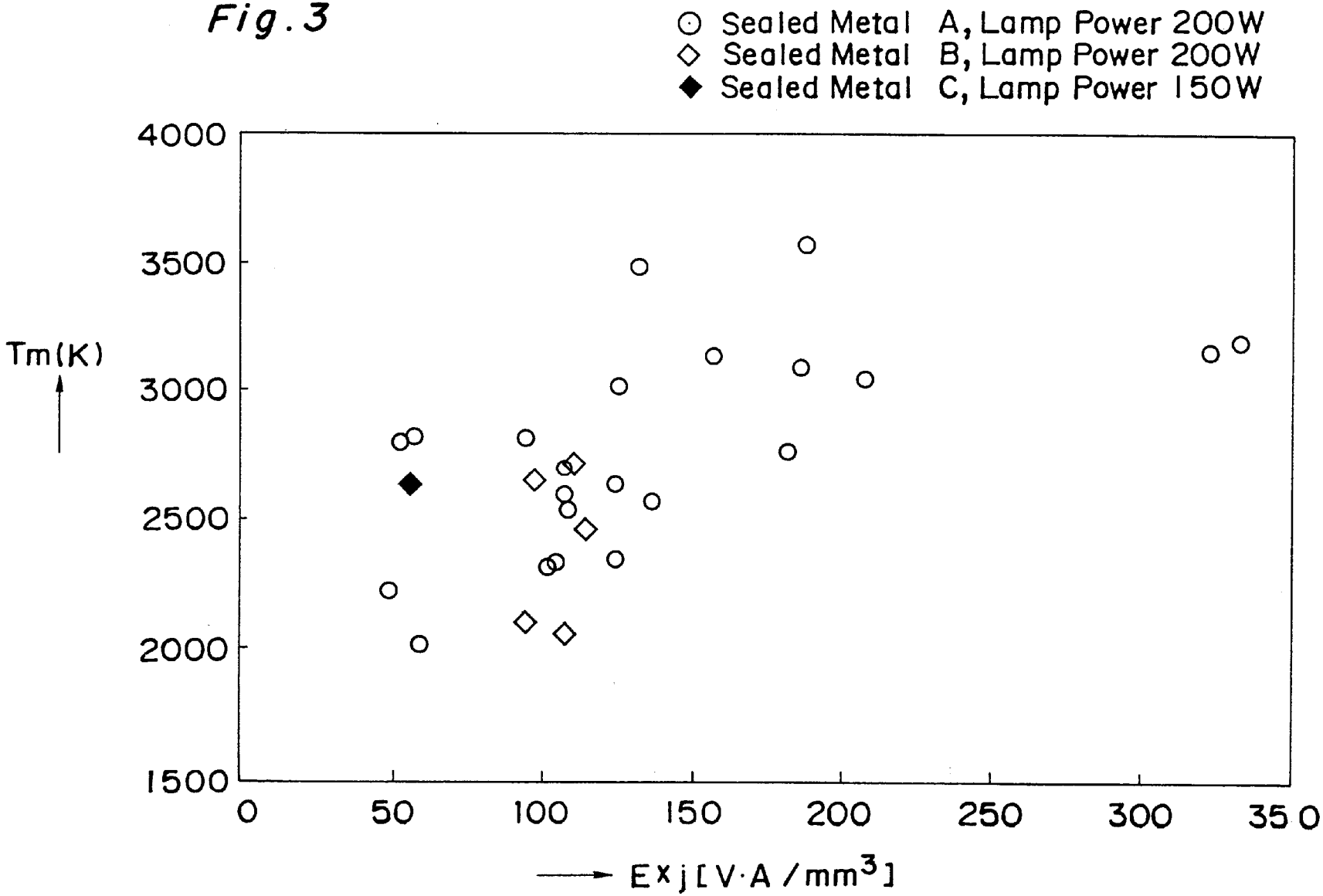
FIG. 3 is a graph showing a relation between a product E×j and a mean value of temperature at the tip portion of an electrode according to the present invention.

FIG. 3 shows a relation of the temperature mean value of the electrode tip portion with respect to the energy density E×j at the light start-up time $t_0$ using the same examples of the lamps as those in FIG. 2. By these measurement results shown in FIG. 3, it is confirmed that, the larger the energy density E×j, the higher the temperature mean value of the electrode tip portion rises.

In this experiment, the measurement of the temperature mean value of the electrode tip portion was carried out by a bi-color radiation temperature measuring method as disclosed in the Japanese Patent Laid-open (Unexamined) Publication (Tokkaihei) 8-152360 published on Jun. 11, 1996 . This method is based on the principle that the spectral radiation luminous ratio of two different homogeneous wavelengths emitted from an object to be measured is represented by a function in relation to a temperature of the object.

In this method of the publication, in order to detect the pure thermal radiation from the electrode part while preventing the mixture with the other radiation from the arc discharge portion, the spectrum distribution in the vicinity of the electrode part is measured by a spectrophotometer having a high resolution of 0.01 nm to obtain two different homogeneous wavelengths of narrow band having very little radiation from the arc discharge portion. Thus, the luminances of the thermal radiation from the electrode part are measured by the two different wavelengths, and then the temperature of the part is obtained by the ratio between the two luminances, where a two-dimensional light-receiving unit such as a CCD camera is used as means for detecting the thermal radiation luminance from the electrode part so that the temperature mean value of the electrode tip portion is obtained.

Figure 4:
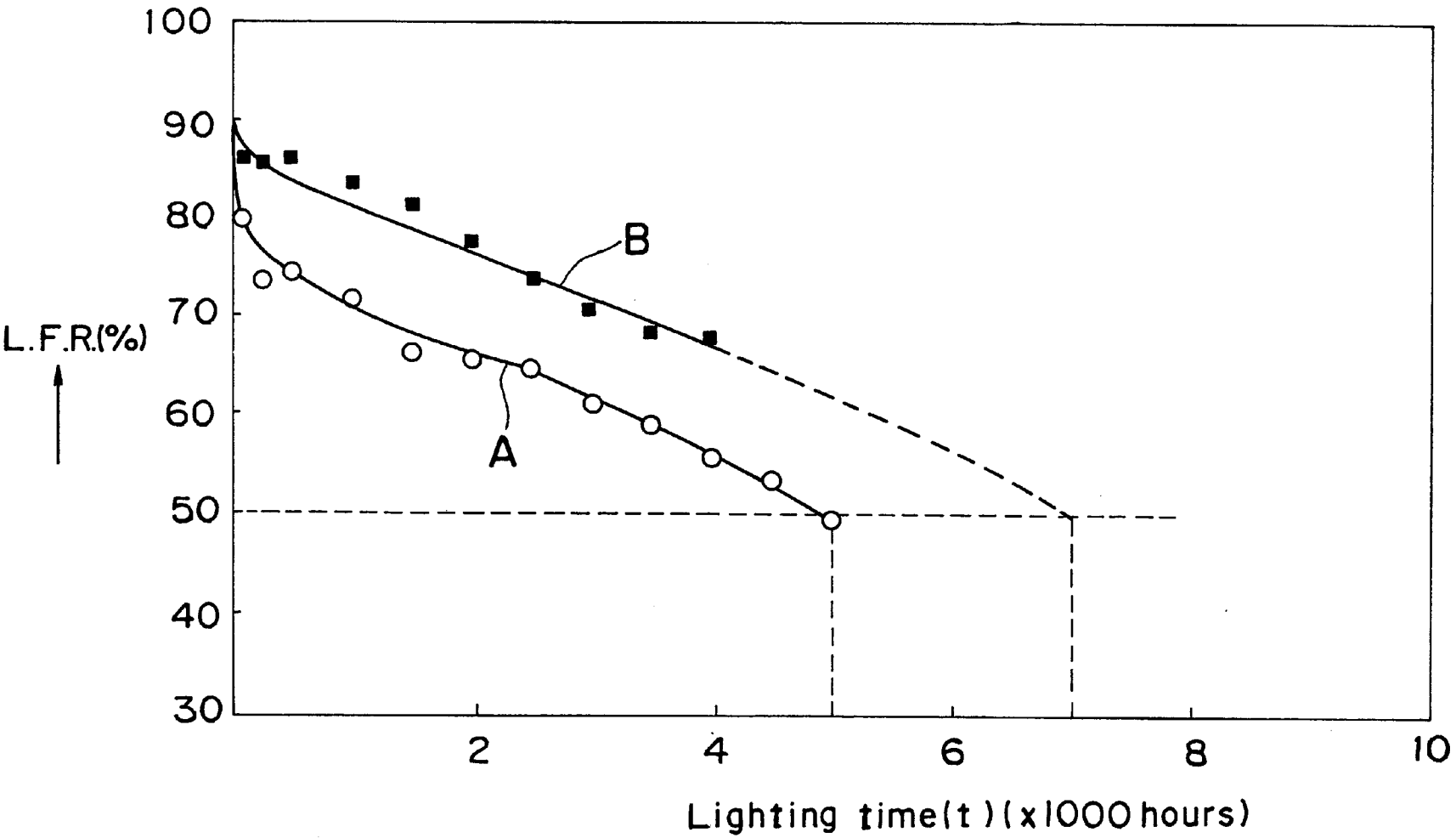
FIG. 4 is a graph showing a relation between a lighting time and a luminous flux retention rate according to the present invention.

FIG. 4 shows a relation of the variation of the luminous flux retention rate with respect to the increase of the lighting time period in two typical cases A and B of metal halide lamps, where the case A designated by ○ marks is an example using a lamp having a luminous flux retention rate of 80% after a time lapse of 100 hours from the light start-up time $t_0$, while the case B designated by ■ marks is an example using a lamp having a luminous flux retention rate of 85% after a time lapse of 100 hours from the light start-up time $t_0$.

Even in the case A, the half life period of the luminous flux retention rate is about 5000 hours of the lighting time period, while in the case B, the half life period of the luminous flux retention rate is about 7000 hours of the lighting time period.

It is noted here that the half life period of 5000 hours is an average value for a general illumination metal halide lamp having a gap distance of 10 mm or more between a pair of discharge electrodes, which life length of 5000 hours is sufficient for the highest level of a metal halide lamp having a small gap distance of nearly 3 mm adapted to be used as a light source incorporated in a projector.

Based on the acquirements of the measurement results shown in FIG. 4, when the reference value of 80% is set up as the necessary luminous flux retention rate at the time lapse of 100 hours in FIG. 2, the energy density (E×j) must be smaller than 150 VA/mm for satisfying the requirement.

In a general illumination type metal halide lamp having a gap distance of 10 mm or more between the discharge electrodes, as manufactured by Matsushita Electric Industrial Co., such as the examples designated by mark ♦ having a gap distance of 10 to 80 mm with lamp power application of 70 to 1000 W in FIG. 2, the lamp of this type is operated with the energy density (E×j) in a range of 69 to 12 VA/mm$^3$, and it is confirmed that there is obtained a desirable luminous flux retention rate of 90% or higher at the time lapse of 100 hours after the light start-up of the lamp as designated by plots in the left upper portion in FIG. 2.

However, when using such a general illumination type metal halide lamp having a large gap distance of 10 mm or more between the paired discharge electrodes, since the luminance of the arc discharge portion is too small and insufficient due to a small lamp electric field, therefore such a general illumination type metal halide lamp can not be used as a light source of a projector incorporated in an optical projection system.

When a luminous flux of a lamp is L (lm) and a gap distance between the discharge electrodes is d (mm), the luminous value L/d (lm/mm) per unit arc length is correlative and nearly equal to the luminance of the arc discharge portion.

Figure 5:
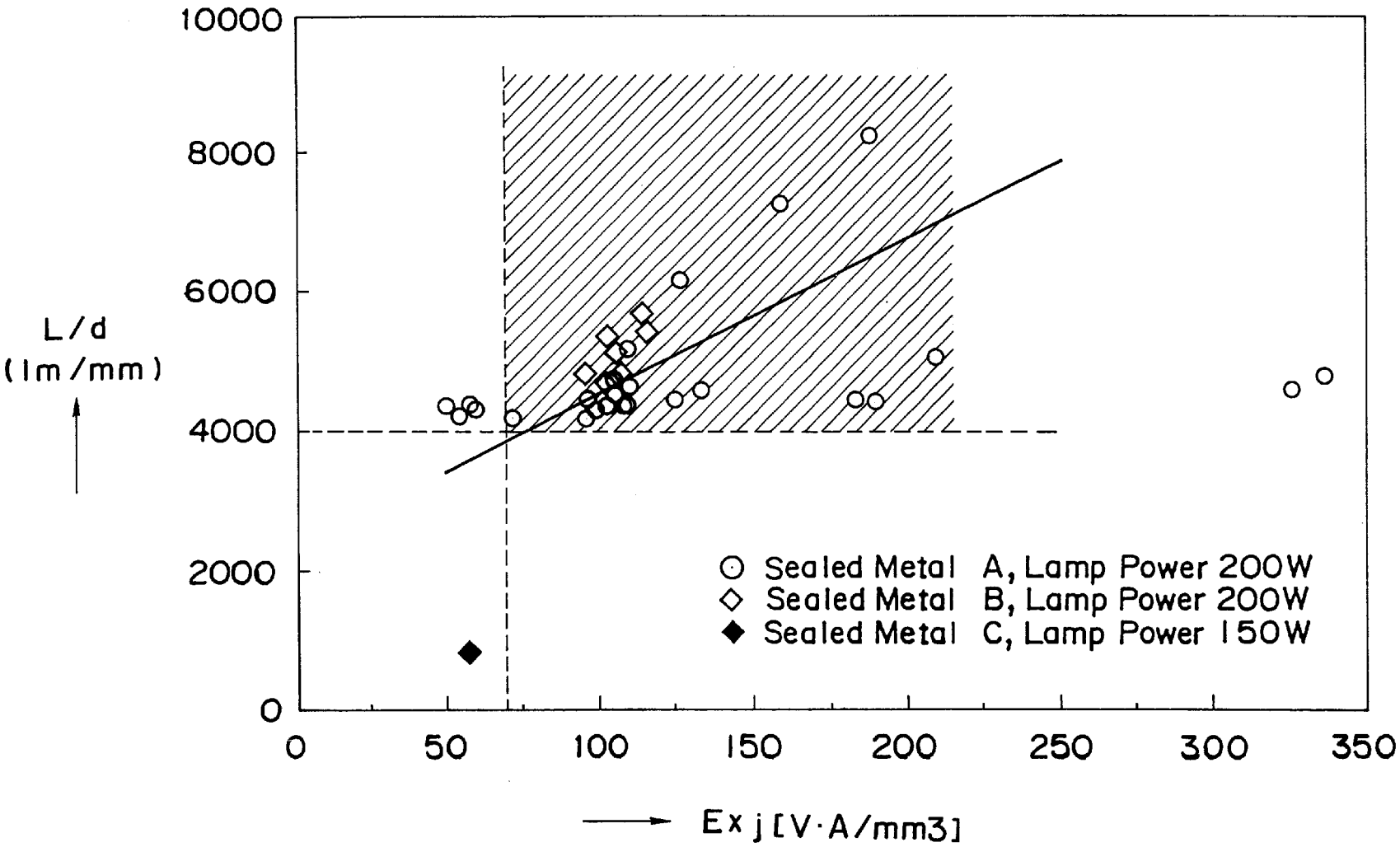
FIG. 5 is a graph showing a relation between a product E×j and a luminous flux per electrode gap distance (L/d) according to the present invention.

FIG. 5 shows a relation between the luminance values L/d per unit arc length represented on the ordinate axis and the product E×j represented on the abscissa axis.

When employing a metal halide lamp of the above mentioned type having a gap distance of 10 to 80 mm between the electrodes operated with lamp power application of 70 to 1000 W and energy density E×j of 69 to 12 (VA/mm$^3$), the value L/d is in the range of 420 to 1060 (lm/mm) which is represented by mark ♦ plotted in a left lower portion in FIG. 5. In this relation in FIG. 5, when the value E×j is decreased, the value L/d is also decreased as shown by a regression line $Rl_2$ thereof.

When a metal halide lamp is used as a light source for illuminating a screen of an optical projector type having a size of generally 40 inches, it is required that the lamp has the value L/d of at least 4000 lm/mm for obtaining a sufficient brightness of the screen. By this requirement, the value of E×j must be larger than 70 (VA/mm$^3$) as shown in FIG. 5 for satisfying the necessary condition.

The reason why the marks ○ and ◇ are dispersed up and down in FIG. 5 with respect to the regression line $Rl_2$ is discussed below.

That is, the feature of the steep incline rising rightward located in the upper portion of the regression line is formed by the plots of a group of lamp samples having the same area S in section of the electrode tip portion and different gap distances d between the paired discharge electrodes, while the feature of the gradual incline rising rightward located in the lower portion of the regression line is formed by the plots of a group of lamp samples having the same gap distance d and different areas S in section of the electrode tip portion. This means that the variation in the gap distance d exerts larger influence on the value L/d than the area S in section. However, in any case, it is always required that the value E×j be larger than 70 (VA/mm$^3$) for obtaining sufficient value L/d of at least 4000 lm/mm.

Figure 6:
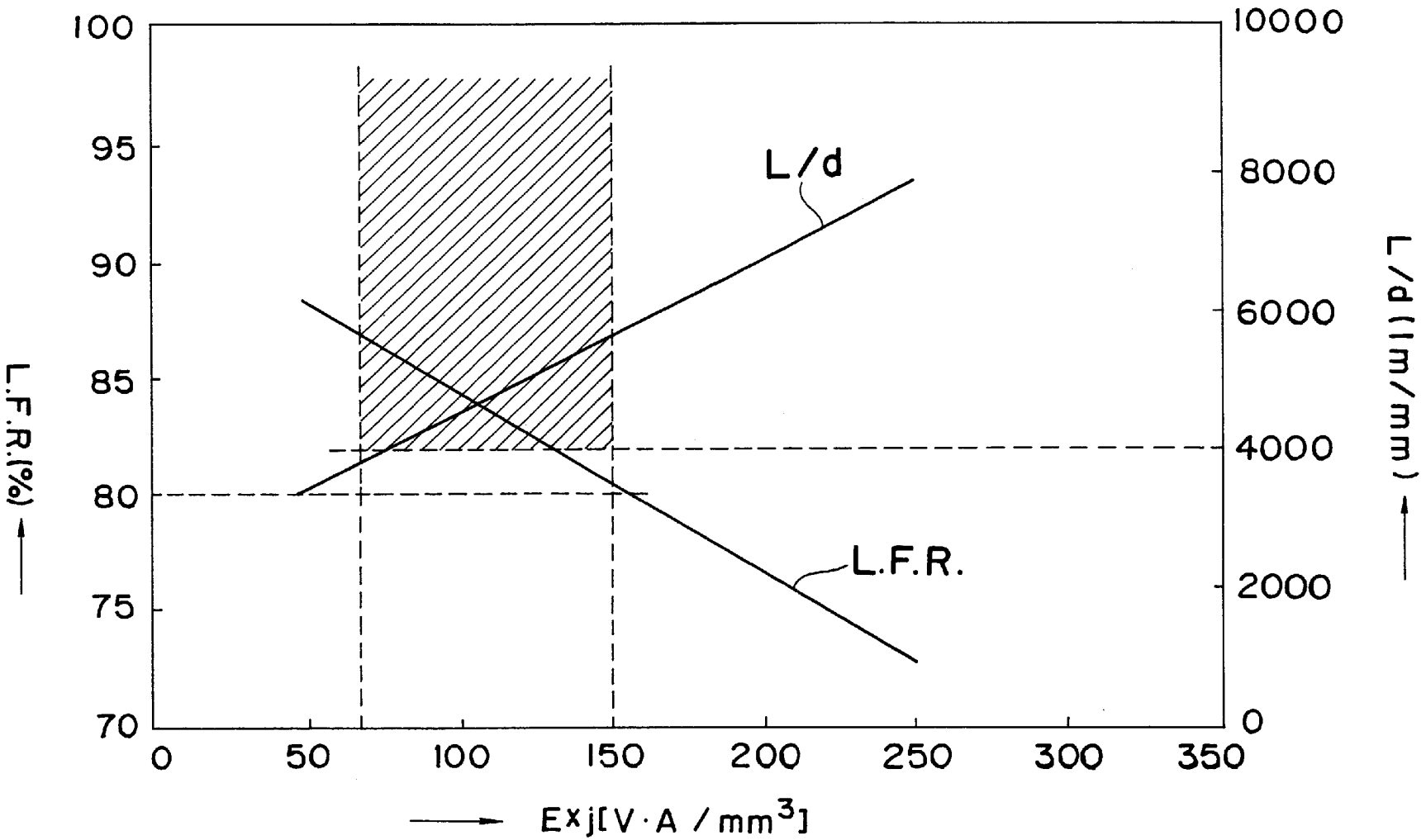
FIG. 6 is a graph showing a relation between a product E×j and a luminous flux retention rate L.F.R. and a relation between a product E×j and a luminous flux per electrode gap distance (L/d) according to the present invention.

Based on the experimental results shown in FIGS. 2 and 5, in order to satisfy the first requirement of having a luminous flux retention rate of at least 80% at the time lapse of 100 hours and also satisfy the second requirement of having the luminance value L/d of at least 4000 lm/mm, the effective product value E×j for the lamp should be in the range of $70.0 \leqq E \times j \leqq 150.0$ (VA/mm$^3$), which effective range is shown in FIG. 6.

The present inventors confirm that the effective range of $70.0 \leqq E \times j \leqq 150.0$ (VA/mm$^3$) as shown in FIG. 6 of the lamp lighting operation is not overlapped by those of the conventional metal halide lamps. This means that in the prior art there has not been taught or suggested any metal halide lamp satisfying the above two requirements, i.e., having a luminous flux retention rate of at least 80% at the time lapse of 100 hours as well as having the value L/d of at least 4000 lm/mm.

By this arrangement, a metal halide lamp can be fabricated for use as a light source having characteristics of high luminance and high luminous flux retention rate, adapted for an essential part of an optical display incorporated in e.g. an optical projection system.

Second Embodiment

The following describes a second embodiment of the present invention with reference to FIGS. 7 to 12.

As described in the first embodiment, when the energy density E×j is decreased as shown in FIGS. 2 and 6, a high luminous flux retention rate can be maintained while suppressing the deterioration thereof, and thus the half-life property of the lamp regarding the luminous flux retention rate is improved as shown in FIG. 4.

However, in the case where there is used a metal halide lamp having a small gap distance of 3 mm or smaller, i.e., in a range of 1.5 mm to 3 mm, adapted to be incorporated in an optical projector and the like, it may be difficult to attain a high luminous flux retention rate merely by reducing the value of E×j in view of fabricating a contour design of the lamp because of the following reasons.

That is, in this type of the lamp having such a small gap distance, the value E×j (=V/d×I/S) is defined by parameters of a lamp power (=V×I), gap distance d between the electrodes and area S in section of the electrode tip portion, where the lamp power is restricted for providing sufficient luminous energy or quantity of light in view of the provision of a lamp lighting circuit, and there have been required further restriction of the gap distance d for arc length between the pair of electrodes for increasing a luminance or brightness of an arc discharge portion in view of an optical requirement. Therefore, only a parameter S of the area in section is available in fabricating the lamp reduction of the value E×j, may be realized by increasing the parameter S.

However, the parameter S also has an upper limit restricted from a viewpoint of a correlation between a dimension in diameter of the arc discharge portion and an optical configuration in design of the lamp. That is, there is a general principle that the dimension in diameter of the arc discharge portion produced between the discharge electrodes is increased when the area S in section of the electrode tip portion is increased.

In particular, in the case where the lamp is used as a light source to be incorporated in an optical condensing projection system, when the diameter of the arc discharge portion is increased, the luminance of the arc discharge portion is reduced, resulting in reduction of the resultant quantity of light to be taken out of the optical projecting system.

Therefore, there may be a case that the parameter S should be restricted to a small value to have an upper limit for suppressing the diameter of the arc discharge portion.

In order to improve the luminous flux retention rate with a fixed value of E×j while fixing the parameter S of the electrode tip area in section, the present inventors have studied and attained a new method by controlling a temperature of the electrode tip portion by adjusting a power source.

Figure 7:
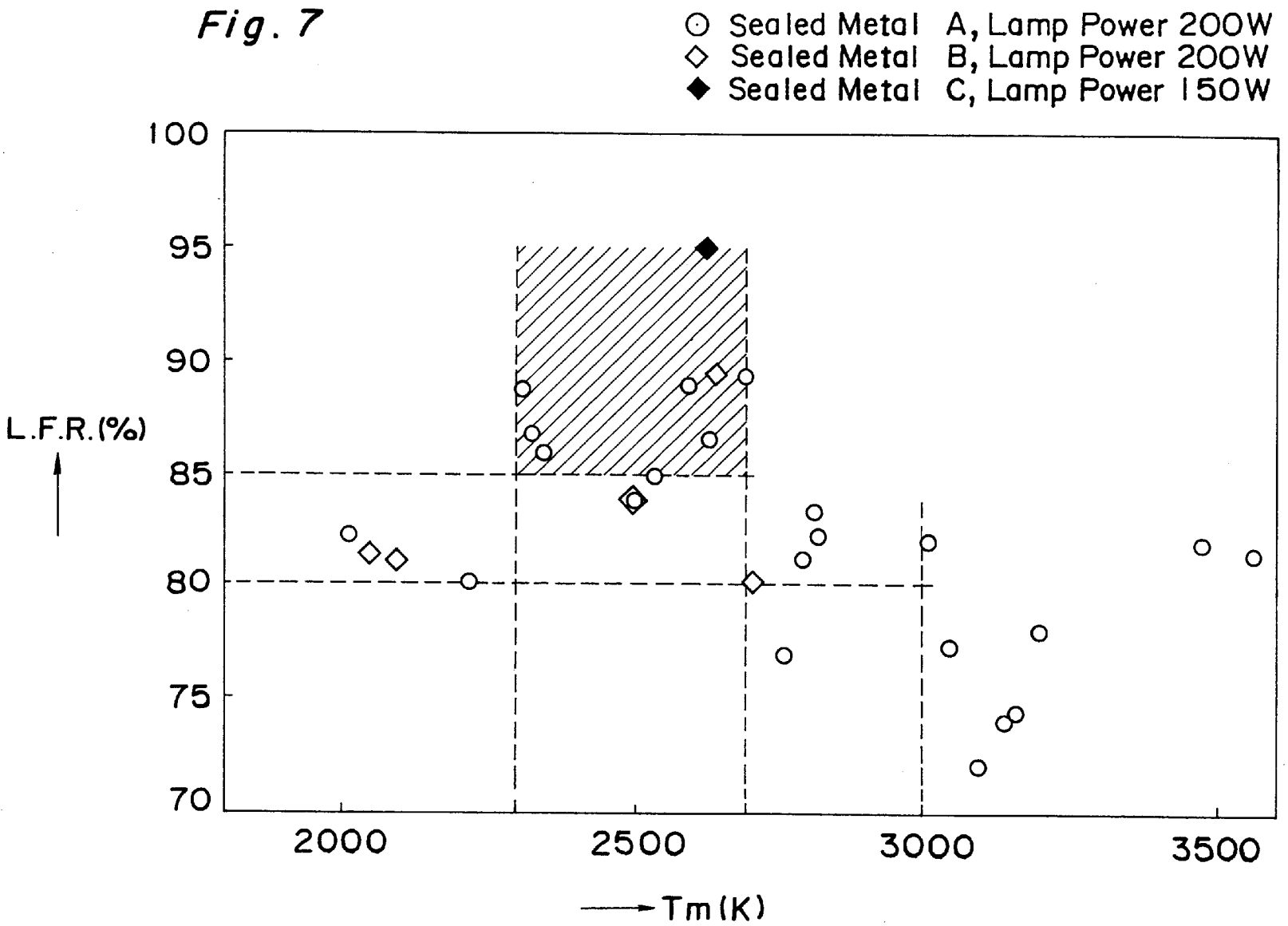
FIG. 7 is a graph showing a relation between a mean value of temperature at the tip portion of an electrode and a luminous flux retention rate according to the present invention.

In more detail, FIG. 7 shows a relation of the luminous flux retention rate at a time lapse of 100 hours represented on the ordinate axis with respect to the mean value Tm of the temperature of the electrode tip portion represented on the abscissa axis using the same lamp examples as those of FIGS. 2 and 3.

Based on the measurement results in FIG. 7, it is confirmed that the temperature mean value Tm should be below 3000 K in order to attain a high luminous flux retention rate of more than 80%.

In particular, in order to attain a higher luminous flux retention rate of 85% or more as described in the preferred embodiment with reference to FIG. 4, the temperature mean value Tm should be within the range of 2300 to 2700 K as defined in FIG. 7. Thus, as shown by the case B designated by ■ marks in FIG. 4, the half life period of the luminous flux retention rate of about 7000 hours can be obtained in lamp lighting time by realizing the high luminous flux retention rate of 85% or higher.

That is, as shown in FIG. 3, there is depicted dispersed difference in temperature mean values of the electrode tip portion with respect to a fixed value of E×j, which difference in temperature mean values causes the differences in luminous flux retention rate in spite of the same value of E×j as shown in FIG. 2.

Figure 8:
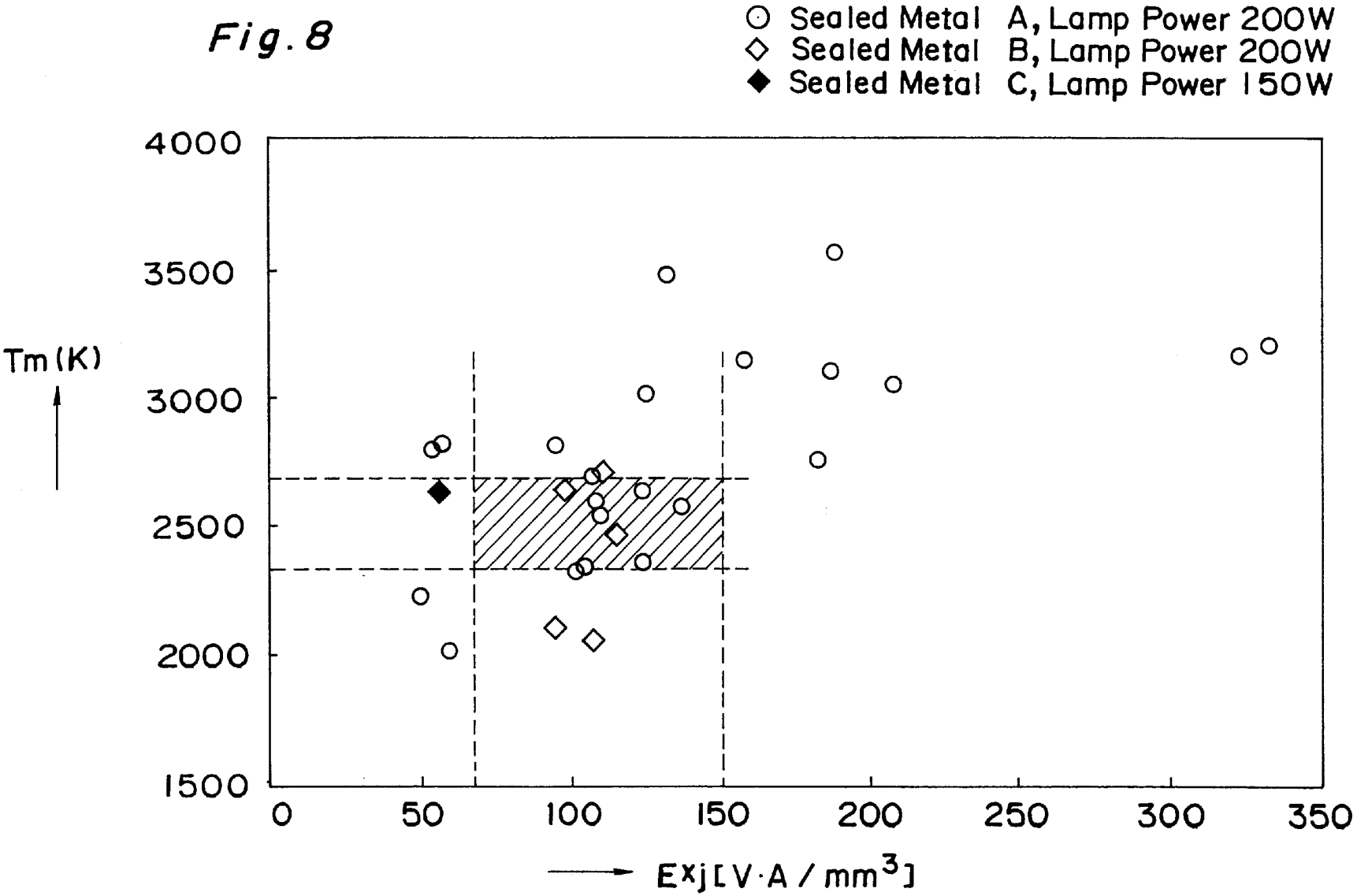
FIG. 8 is a graph showing a relation between a product E×j and a mean value of temperature at the tip portion of an electrode according to the present invention.

FIG. 8 shows a preferred range of the temperature mean value Tm of the electrode tip portion with respect to the optimum value of the product E×j obtained by combining the conditions of FIGS. 6 and 7. By defining the optimum ranges of both the temperature mean value within the range of 2300 to 2700 K and the product value E×j within the effective range of $70.0 \leqq E \times j \leqq 150.0$ (VA/mm$^3$) in fabricating the metal halide lamp, a high luminous flux retention rate of more than 85% can be realized together with a half life property of 7000 hours of lamp lighting time regarding the luminous flux retention rate.

Figure 9:
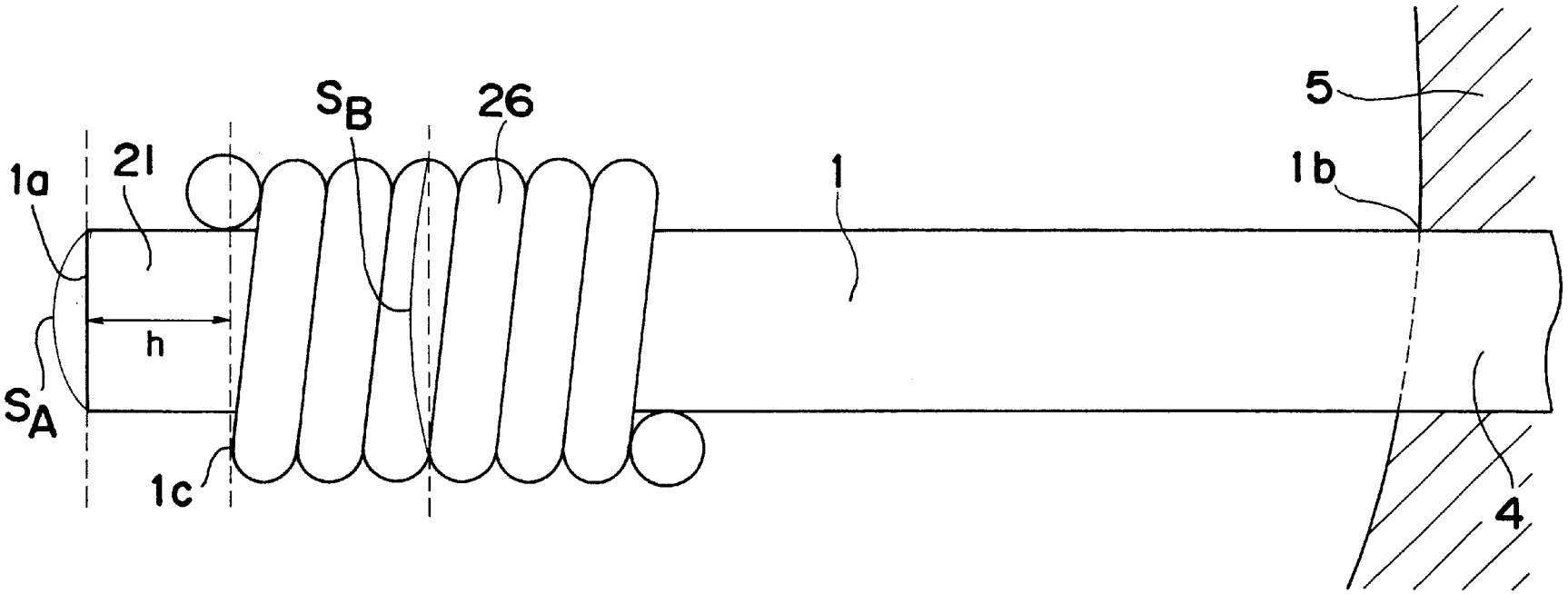
FIG. 9 is a schematic view showing a construction of an electrode for use in a metal halide lamp of the second embodiment according to a present invention.

FIG. 9 shows an example of a method for defining an optimum range of the temperature mean value Tm of the electrode tip portion in order to attain a high luminous flux retention rate with a fixed value of E×j (=V/d×I/S), i.e., with the fixed values of lamp power (W), gap distance (d) and area (S) in section of the electrode tip portion.

In FIG. 9, the column-like discharge electrode 1 is integrally protruded in the discharge tube 2 from the electrode shaft 4 inserted in the sealing member 5, and there is formed a diameter-increased or diameter-reduced portion between the tip end 1*a* and a base portion 1*b* thereof to have a varied area $S_B$ in section different from the area $S_A$ in section of the other portion of the protruded electrode shaft 1.

As shown in FIG. 9, when a diameter-increased portion is formed in an intermediate frontward portion of the protruded column-like electrode shaft 1, there is provided e.g. an electrode coil member 26 made of the same tungsten material wound by welding on the protruded electrode shaft 1.

In FIG. 9, a tip end portion 21 between the tip face 1*a* of the protruded electrode shaft 1 and the top end 1*c* of the electrode coil member 26 has a length of h mm, which is referred to as "tip length" hereinafter. The present inventors have determined that there is a correlation between the tip length h and the temperature mean value Tm of the electrode tip portion 21 and found that the temperature mean value can be controlled by varying the tip length h.

Figure 10:
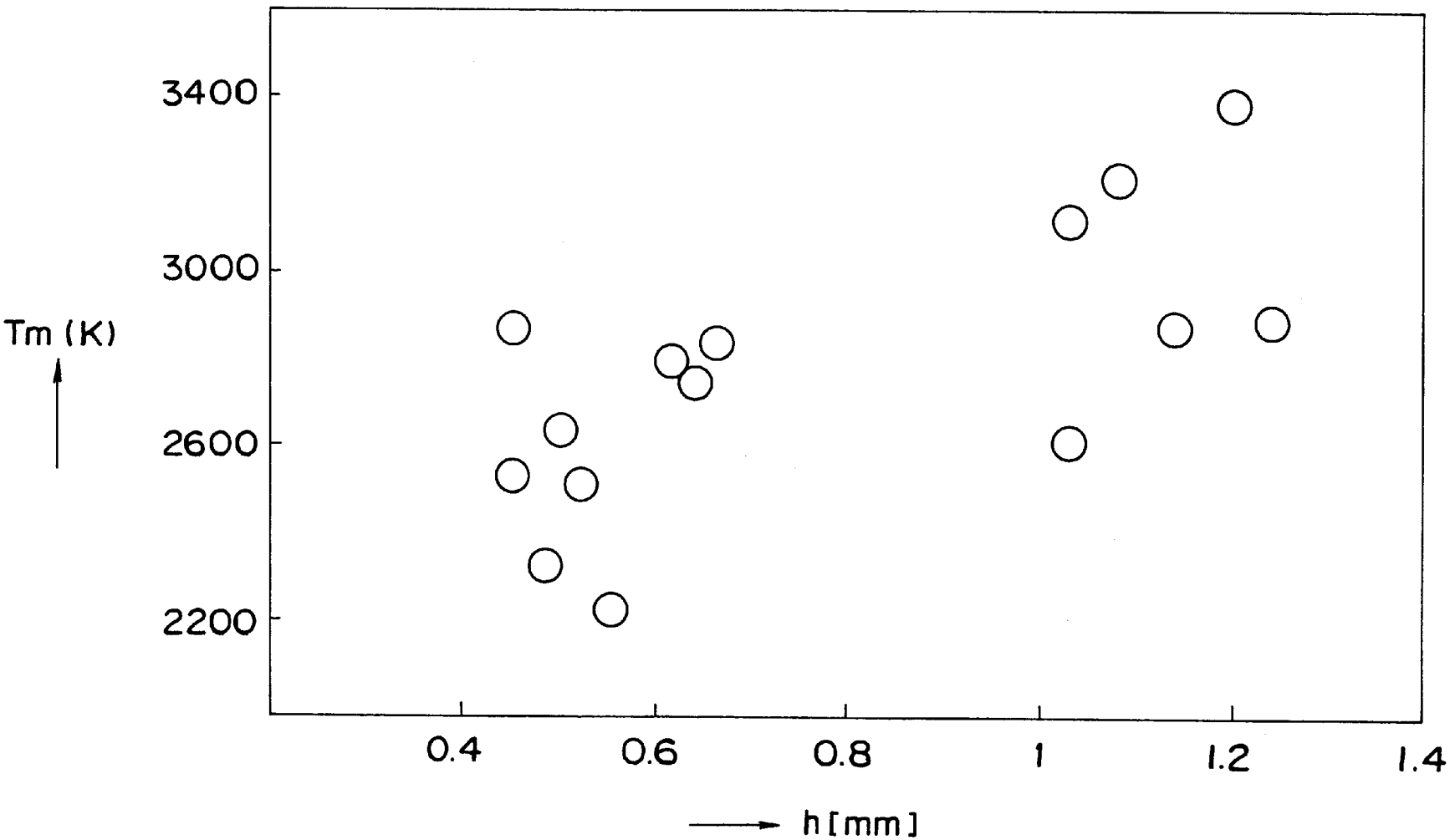
FIG. 10 is a graph showing a relation between a length of a protruded portion and a mean value of temperature at the tip portion of an electrode according to the present invention.

FIG. 10 shows a relation between the temperature mean value Tm on the ordinate and the tip length h on the abscissa axis with a preferred effective energy density within the range of $100 \leqq E \times j \leqq 120$ VA/mm$^3$ while fixing the values of lamp power (V×I), gap distance d and area S in section of the electrode tip portion.

As shown in FIG. 10, it is confirmed that the temperature mean value Tm is reduced as the tip length h is reduced. By this arrangement, the temperature mean value Tm can be optimized by adjusting the tip length h, i.e., by adjusting the position of providing the electrode coil member 26 on the protruded electrode shaft 1, and thus a high luminous flux retention rate can be attained with the fixed value of E×j, thereby preventing the deterioration of the luminous flux retention rate.

Figure 11:
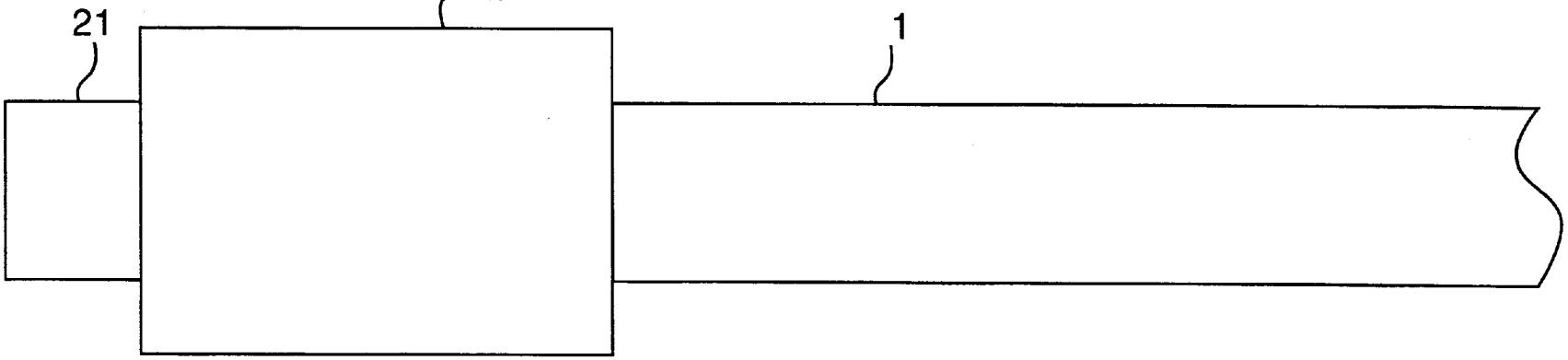
FIG. 11 is a schematic view showing a modified example of an electrode for use in a metal halide lamp of the second embodiment according to the present invention.
Figure 12:
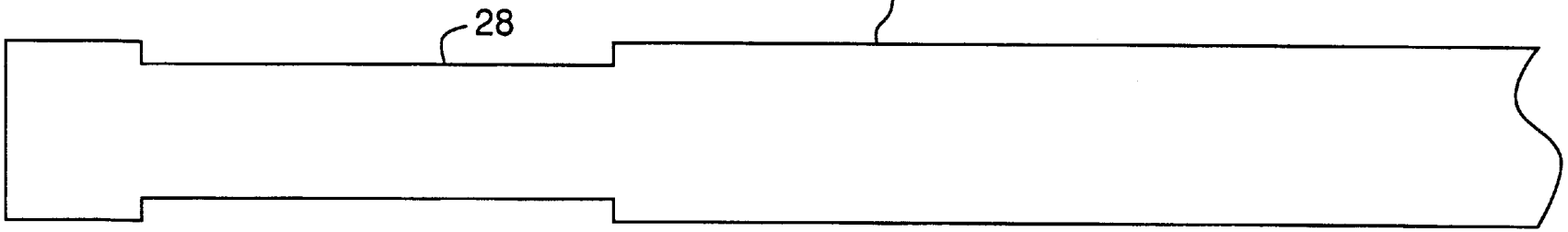
FIG. 12 is a schematic view showing another modified example of an electrode for use in a metal halide lamp of the second embodiment.

The diameter-increased portion or diameter-reduced portion may be integrally formed by machining or cutting the protruded electrode shaft 1 as shown in FIGS. 11 and 12 instead of providing a coil member.

Figure 13:
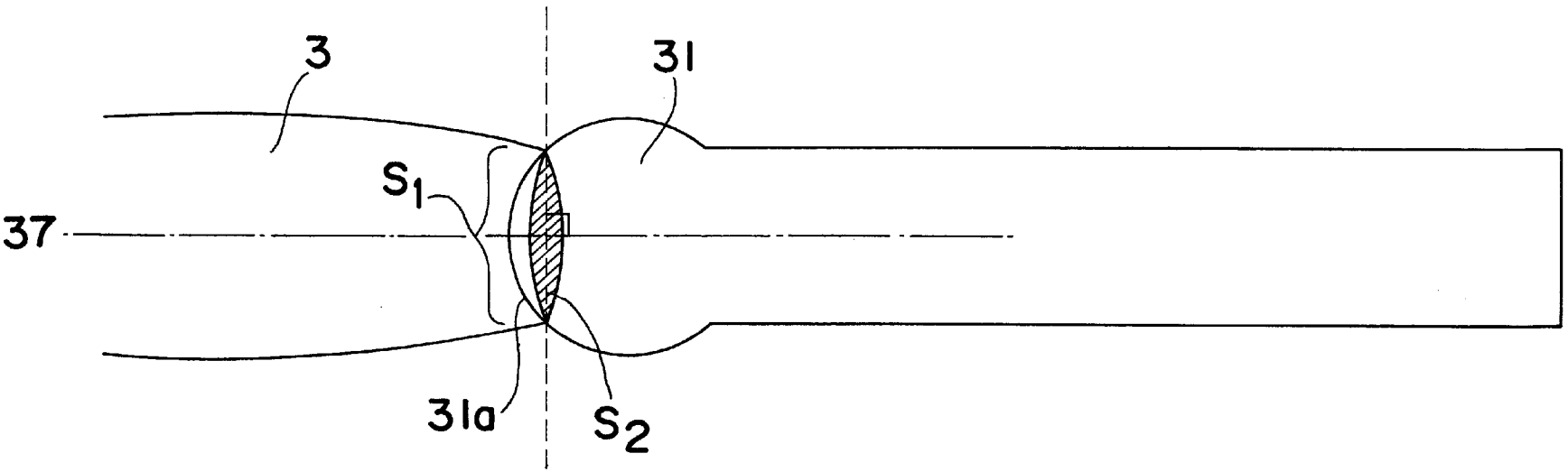
FIG. 13 is a schematic view showing a further modified construction of an electrode for use in a metal halide lamp of the second embodiment.

FIG. 13 shows a modified example of an electrode tip portion 31 having a curved surface 31*a* corresponding to a supporting part of the arc discharge portion 3. The curved surface 31*a* has an actual surface area S1 and a vertical section area S2 perpendicular to the arc discharge axis 37. In this case, the vertical section area S2, which is the smallest in area of the discharge supporting portion, is considered as the cut area S in section of the electrode tip portion, and with the smallest area S, the product value E×j becomes the largest, which is the lowest condition regarding the luminous flux retention rate with reference to FIG. 2. The actual surface area S1 is larger than the vertical section area S2, and when S1 is considered as the cut area S in section, the luminous flux retention rate is raised to be improved.

Third Embodiment

Figure 14:
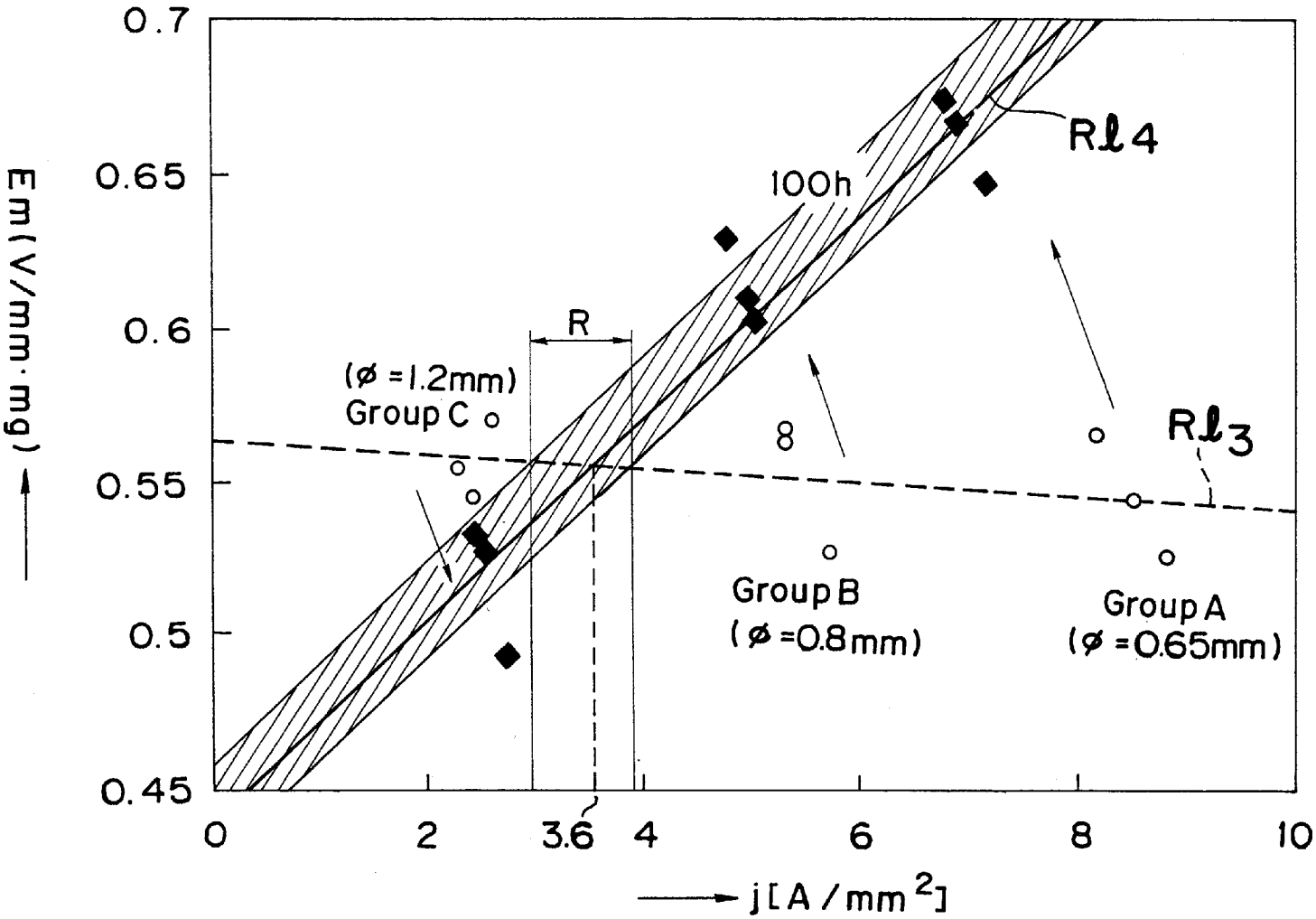
FIG. 14 is a graph showing a relation between a current density j and an electric field Em per a quantity of filled mercury.
Figure 15:
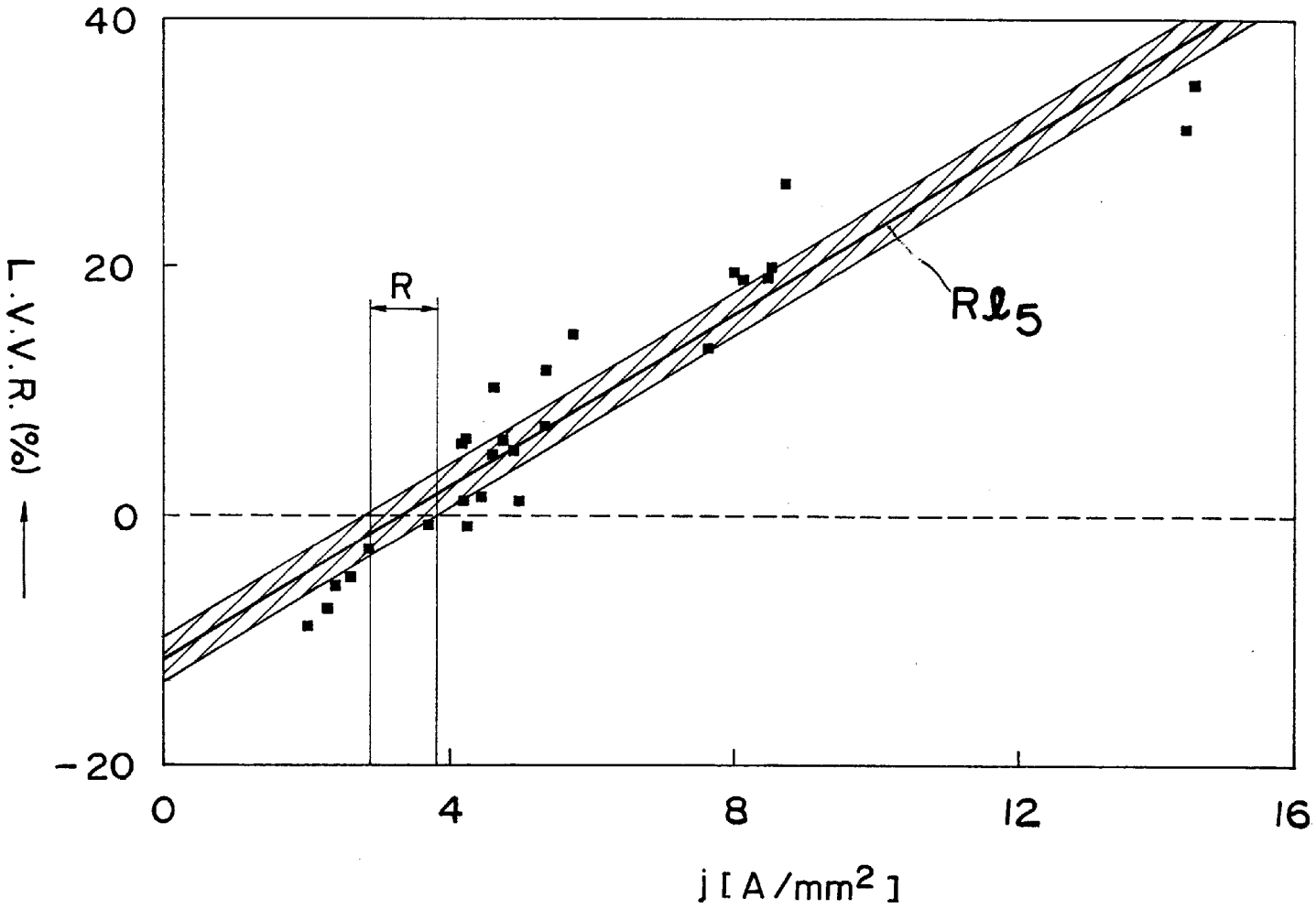
FIG. 15 is a graph showing a relation between a current density and a lamp voltage varying rate.
Figure 16:
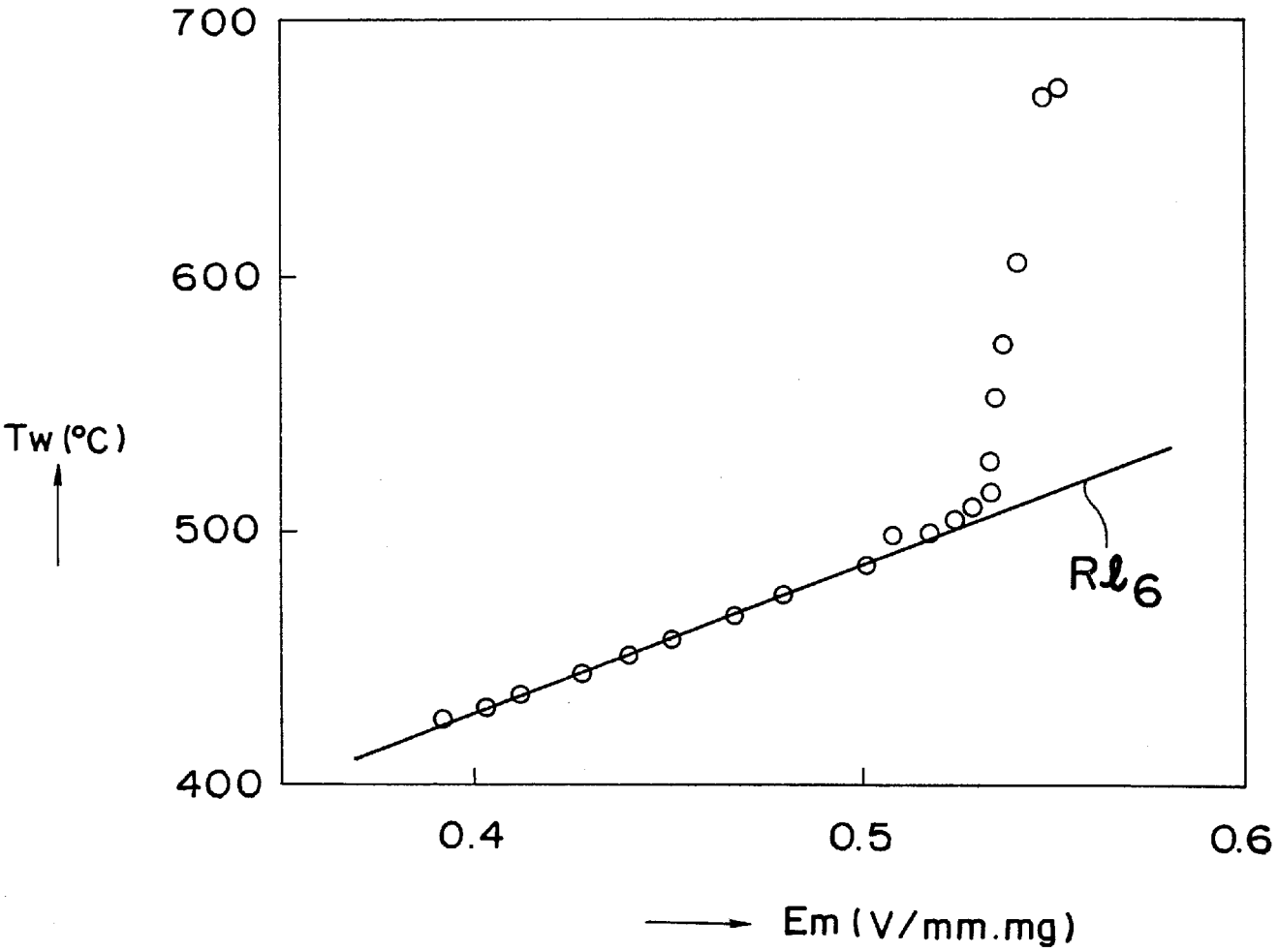
FIG. 16 is a graph showing a relation between an electric field Em per quantity of filled mercury and a temperature Tw of a discharge tube wall.

The following describes a third embodiment of the present invention with reference to FIGS. 14 to 16.

A construction of a metal halide lamp of the third embodiment is similar to that of the first embodiment shown in FIG. 1 except for the following features.

That is, in the third embodiment, the mass m of the mercury fill sealed in the discharge tube 2 is fixed to be m=42 mg which is used as a factor for optimizing the range of the current density j (=I/S) under application of a constant lamp power with a constant configuration in dimension of the discharge tube, i.e., having fixed values of a gap distance d=3 mm, while varying the diameter ϕ (i.e., varying the cut area S in section) of the protruded electrode shaft 1 with use of the same metal halide material sealed in the discharge tube.

In this arrangement, experimental measurement was carried out for examining the changes in lamp characteristics at the time lapse $t_{100}$ of 100 hours with respect to the light start-up time $t_0$ under application of the constant lamp power of P=200 W with initialized lamp voltage of V=70V, using three groups A to C of lamp samples having three different diameters ϕ=0.65 mm, 0.8 mm and 1.2 mm of the electrode tip portion, where the sampling number of the lamps of each group is three, assuming that the mass of the mercury fill within the discharge tube is not varied in the time lapse of 100 hours.

FIG. 14 shows a relation between the lamp electric field Em per unit mass of the mercury fill represented on the ordinate axis and the current density j on the abscissa axis, where Em=V/d/m, and j=I/S.

In FIG. 14, the plots of marks ○ denote the measurement results at the lamp start-up time of which the regression line is indicated by a broken line Rl3 while the plots of marks ■ denote the measurement results at the time lapse of 100 hours of which the regression line is indicated by a real line Rl4.

On the regression broken line Rl3 representing the measurements at the lamp start-up time, the plots of the group A samples having an electrode diameter of $\phi$=0.65 mm are located at a position where j is nearly equal to 8.3 A/mm$^2$, the plots of the group B samples having an electrode diameter of $\phi$=0.8 mm are located at a position where j is nearly equal to 5 A/mm$^2$, and the plots of the group C samples having an electrode diameter of $\phi$=1.2 mm are located at a position where j is nearly equal to 2.5 A/mm$^2$.

In this graph, the regression broken line Rl3 is almost horizontal with slight inclination. This is because the lamp voltage values as well as the lamp current values are little varied and almost equal in the all samples at the light start-up time while only the current density j (=I/S) is varied in accordance with the different diameters of the electrode tip shafts.

That is, in this embodiment, in the case where the parameters of the dimension in configuration of the discharge tube, gap distance and mass of the mercury fill are fixed, the lamp voltage V is generally defined by the pressure of the unsaturated vapor of the mercury fill, and therefore the lamp voltage values are almost equal. Under application of the same electric power of P=200 W, the lamp current is accordingly equal in all of the samples at the lamp start-up time, and these features are merely in a starting condition for designing the lamps in configuration.

When examining the changes of the plots at the time lapse $t_{100}$ from the lamp start-up time $t_0$, the regression real line Rl4 is linearly rising upward and rightward and is represented by an approximation formula as below:

$$j=30.5\times Em-13.4 \quad (1)$$

Based on the measurement results as shown in FIG. 14, it is confirmed that, i) the lamp voltage V and lamp current I are both varied in the time lapse of 100 hours in such a manner that the plots of the measurements are located on the graph where the relation between the electric field Em per unit mass of mercury fill and the current density j is represented by a linear line having a certain inclination, and ii) the variation rates in lamp voltage and lamp current are larger when the geometrical distances from the plots on the regression broken line Rl3 at time $t_0$ to the plots on the regression real line Rl4 at time $t_{100}$ are the larger.

In general, when the lamp configuration is to be improved with improved lamp characteristics, it is essentially important to suppress the change in lamp voltage in the time lapse of 100 hours from the light start-up time.

In view of the graph in FIG. 14, the effective range for suppressing the change in lamp voltage in the time lapse of 100 hours is indicated by the intersecting portion between the regression broken line Rl3 and the regression real line Rl4 where the variation in Em and j is least and then the current density j at this position reads nearly equal to 3.6 A/mm$^2$.

FIG. 15 shows a relation between the variation rate (%) in lamp voltage at the time lapse of 100 hours on the ordinate axis and the current density j at the light starting-up time on the abscissa axis using a lot of lamp samples having the same parameters as those used in FIG. 14, while the parameter of diameter $\phi$ of each protruded electrode shaft is changed, where the real line Rl5 is a regression line of the plots.

In this graph, the position of having no variation rate (i.e., 0%) in lamp voltage is read at a point of the current density j=3.5 A/mm$^2$, which is nearly coincident with the resultant value obtained from FIG. 14. In this case, the diameter $\phi$ of the electrode tip portion is 1.02 mm when the variation rate in lamp voltage is 0%.

In FIG. 15, in consideration of differences in individual lamp characteristics, the effective range between the variation rate in lamp voltage and the current density is depicted by an inclined lined portion, having differences in dispersion of ±2% with respect to the real line Rl5. Thus, the effective range indicated by an arrow R of the current density at the time $t_0$ is defined in FIG. 15 by taking the overlapped portion with the 0% level of the variation rate in lamp voltage, and the effective range R of the current density is similarly depicted in FIG. 14.

Thus, the inclined lined portion in FIG. 14 is obtained by shifting the linear line Rl4 represented by the formula (1) in parallel thereto within the range of the effective current density mentioned above so as to obtain the range represented by a formula (2) as below.

$$j=30.5\times Em+a \quad (2)$$

where "a" is in the range of $-14.0 \leqq a \leqq -13.0$.

When taking account of the differences in dispersion of the characteristics of the individual lamp samples, it is confirmed that the permissible range represented by the formula (2) is effective in designing the configuration of the lamps. It is noted here that, when the parameter "a" in formula (2) satisfies the range mentioned above, the diameter $\phi$ of the protruded electrode shaft ranges from 0.98 to 1.12 mm.

When the effective range is obtained on the regression real line in FIG. 14, the current density j and the electric field Em per unit mass of the mercury fill are adjusted to be on the real line to thereby suppress the variation in lamp voltage. By this optimum combination of the effective ranges of Em and j, the variation rate in lamp voltage can be effectively suppressed even when the condition of the parameters at the time $t_0$ of the fabrication starting point of the lamps is displaced up and down with respect to the regression broken line Rl3 in FIG. 14.

Another example of configuration of lamps is described below using the same discharge tubes as those used in the measurement of FIG. 14.

In this example of the lamps, the gap distance d between the paired electrodes is fixed to d=1.8 mm under the same lamp power P=200 W as a load to be applied to the discharge bulb wall, where the mass of the mercury fill sealed in the discharge tube is 62 mg for securing the pressure-proof property of the discharge tube.

Under these conditions, by employing the Elenbaas Experience Law represented by a formula $E\alpha m^{7/12}$, where E is a lamp electric field and m is a mass of the unsaturated sealed mercury fill as disclosed in the document "THE HIGH PRESSURE MERCURY VAPOUR DISCHARGE" by Elenbaas, published by NORTH-HOLLAND PUBLISHING COMPANY in 1951, the lamp voltage is calculated by an equation $$V/1.8/62^{7/12}=70/3/42^{7/12}$$

and accordingly, V=52.7 is obtained. Thus, the electric field Em per unit mass of the mercury fill is obtained by $$Em=V/d/m=0.472$$

By substituting Em into the formula (2), j=1.018 is obtained.

This means that the optimum combination of Em=0.472 and j=1.018 is taken on the regression real line Rl4 in FIG. 14 for lighting the lamp.

Since the lamp voltage V=52.7 V is obtained under application of the lamp power P of 200 W, the lamp current I=200/52.7=3.795 A is obtained. Accordingly, the diameter ϕ of the protruded electrode shaft for satisfying the current density j=1.018 is calculated as ϕ=2.17 mm.

Fourth Embodiment

The following describes a fourth embodiment of the present invention with reference to FIGS. 14 to 18.

Although an example of optimum combination of the parameters Em and j in configuration of the lamps is described in the third embodiment, there may be a case where it is difficult to realize the optimum condition by the method of the third embodiment, i.e., in case that the calculated value of the diameter ϕ of the protruded electrode shaft is excessively large to be employed in the lamp.

That is, the maximum value of the diameter of the electrode shaft is restricted in view of the two reasons, i) securing the pressure-proof property of the discharge tube, and ii) thickness or diameter of the arc discharge portion in consideration of the optical requirements.

As to the first viewpoint i), in a general metal halide lamp as shown in FIG. 1, since the bulb wall 2*a* of the discharge tube 2 made of e.g. a quartz glass or the like material is sealed by melting at both of the base portions 1*b* and 1*b*' of the protruded electrode shafts 1 and 1' inserted therein, therefore, when the diameter of the electrode shaft is excessively large, there may be apt to cause a gap around the base portions in the discharge bulb wall undesirably, resulting in deterioration of the strength in pressure-proof property of the discharge tube. This means that, when the diameter of the electrode shaft is excessively large, there may arise an undesirable case that the discharge tube can not endure in view of the pressure-proof property thereof even under the same conditions of the power supply as a load applied to the bulb wall including the same mass of the mercury fill sealed therein.

As to the second viewpoint ii), as described in the second embodiment, there is a general principle that the dimension in diameter of the arc discharge portion is increased as the diameter (i.e., area S in section) of the electrode tip portion is increased.

In particular, in the case where a lamp is used as a light source to be incorporated in an optical condensing projection system, when the diameter of the arc discharge portion is increased, the luminance of the arc discharge portion is reduced, resulting in reduction of the resultant quantity of light to be taken out of the optical projecting system.

Therefore, there may be a case that the diameter of the electrode shaft should be restricted below a maximum limit for suppressing the diameter of the arc discharge portion.

Referring to FIG. 14 again, although the available combination of Em and j is the plots in the range of the real line Rl4, in the case of using the smaller diameter of the electrode shaft than the optimum condition, this indicates that the lamp lighting operation is effected under the condition displaced rightward in the right side of the real line Rl4 in the graph.

Under this condition, in order to shift the lamp operating point onto the real line Rl4 for the optimum condition, it may be realized by increasing the intensity of the electric field Em. Since the lamp power is constant, the current density j is accordingly reduced as the electric field Em is increased, so that the actual lamp operating points are shifted upper and leftward to be put on the real line range.

In order to vary the electric field Em with the fixed values of the lamp power, and fixed shape and dimension of the discharge tube having the fixed mass of the mercury fill sealed therein, there may be utilized a correlation between the temperature (Tw) of the discharge bulb wall and the electric field Em per unit mass of the mercury fill.

FIG. 16 is a graph showing the correlation between the temperature Tw of the discharge bulb wall on the ordinate axis and the electric field Em per unit mass of the mercury fill on the abscissa axis, and the measurement of the temperature of the discharge bulb wall was carried out in the procedure as follows.

With use of the same lamps as those used in the measurement in FIG. 14, a narrow nozzle (not shown) is provided just below a lower portion of the discharge tube for blowing cooling air to a measurement point thereof under the condition that the lamp in lighting operation is in a horizontally laid state. By varying the quantity of the blowing air for cooling, the bulb wall temperatures at a plurality of air blown portions as well as the corresponding lamp voltages are measured under application of a constant lamp power.

Based on the measurement results shown in FIG. 16, it is confirmed that the electric field Em per unit mass of the mercury fill is linearly increased from 0.39 to 0.53 V/mm/mg while the bulb wall temperature Tw is raised from 430 to 530° C. as represented by a regression real line Rl6. In the meanwhile, the electric field Em is little varied in the range of the temperature rising from 530 to 670° C.

This is because, it is interpreted that, in the range of the temperature from 430 to 530° C., the lamp voltage is decided by the temperature of the measurement spot by the effect of the cooling air blown thereto; that is, the temperature measurement spot has a lower-most point in temperature which defines the evaporation pressure inside the discharge tube. While in the range of the temperature from 530 to 670° C., since the cooling air is reduced to be blown to the measurement spot, the lower-most point in temperature is moved to the other position from the measurement spot, and therefore the variation in temperature of the measurement spot has no influence on the variation in lamp voltage.

That is, in order to increase the electric field Em with the fixed values of lamp power and fixed shape and dimension of the discharge tube having a fixed mass of the mercury fill, it can be realized by raising the temperature of the lower-most point of the discharge bulb wall.

Figure 18:
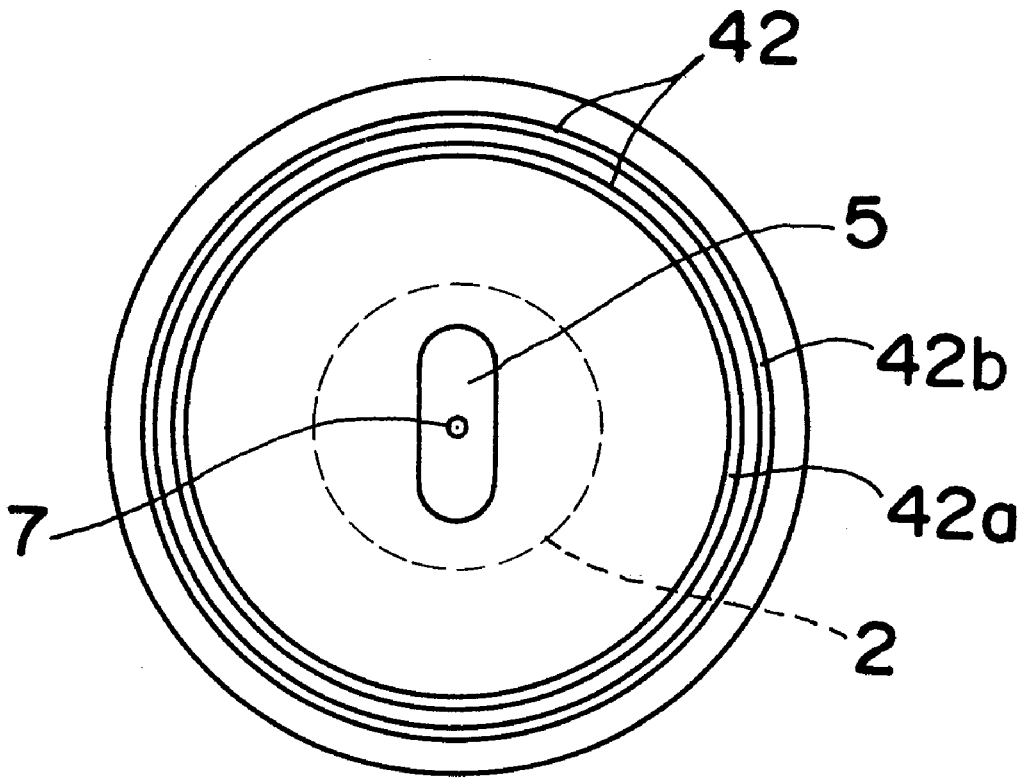
FIG. 18 is a side view of the metal halide lamp shown in FIG. 17.

FIGS. 17 and 18 show a temperature control system for a metal halide lamp including a heater unit for heating the bulb wall of the discharge tube to increase the electric field Em to thereby shift the light operating point of the lamp onto the real line Rl4 shown in FIG. 14. In this arrangement, since the lamp power is constant, the current density j is reduced in accordance with the increase of the electric field Em, so that the actual lamp operating points are shifted upper and leftward to be put on the real line range as shown in FIG. 14.

In the lamp system shown in FIGS. 17 and 18, the metal halide lamp is enclosed inside a double-pipe structure portion 42 inserted through a pair of vertical walls 42*c* and 42*c*'. The double-pipe structure portion 42 has cylindrical-like duplex inner and outer walls 42*a* and 42*b* made of e.g. quartz glass which contain a pair of heating wires 41 and 41' inserted by winding at both side portions therein between the double-structure walls 42*a* and 42*b* with a space having no provision of the heating wire at the intermediate porion therein. This is because, if the heating wire is provided at the intermediate portion in the double structure walls, this prevents the output transmission of the light emission from the arc discharge portion generated inside the discharge tube.

The vertical walls 42*c* and 42*c*' are closely sealed with the sealing members 5 and 5' of the discharge tube for maintenance of the high temperature obtained by the heater unit.

In particular, since the lower-most point may be generally positioned at the electrode base portion 1*b* (1*b*') in many cases, therefore each of the heating wires is arranged in such a manner that, the density of the windings thereof is increased inwardly from the vertical wall portion 42*c* (42*c*') to the intermediate portion corresponding to the electrode base portion 1*b* (1*b*') for effectively heating the discharge bulb wall.

In this lamp system, a temperature control unit 45 is provided for supplying electric current to the heating wires flowing therethrough for heating. The lamp voltage applied to the metal halide lamp is detected by providing a lamp voltage detector 43 connected to the outlet terminals 7 and 7' and the output signal of the lamp voltage detector 43 representing the detection value is inputted to a calculation control unit 44. The outlet terminals 7 and 7' of the discharge tube 2 are also connected to the power supply source 47 by way of a stabilizer 46 for supplying the lamp power to the discharge tube 2.

In the calculation control unit 44, data of the fixed values of the lamp power P, gap distance d, mass of the sealed mercury fill and area in section S (i.e., diameter ϕ) of the electrode tip portion have been previously inputted for calculating the data of the graph shown in FIG. 16, and when the data signal of the lamp voltage value is applied from the lamp voltage detector 43, it is judged by the calculation control unit 44 whether or not the lamp operating points are put on the regression real line Rl4 shown in FIG. 14, based on the data of the graph shown in FIG. 16. The resultant control signal of the calculation judgement is outputted from the calculation control unit 44 and applied to the temperature control unit 45 for controlling the supply of the heating current.

When it is judged in the calculation control unit 44 that the lamp operating points are put on the real line Rl4 or the like condition which does not need the current to flow in the heating wires, then the heating current is not supplied from the temperature control unit 45 to the heating wires.

Meanwhile, when it is judged that lamp operating points are displaced from the real line Rl4 or the like condition requiring the current to flow in the heating wires, then the heating current is supplied to the heating wires to thereby effectively heat the entire part of the discharge tube. By this arrangement, even when the lower-most point in temperature is positioned elsewhere on the discharge bulb, the lamp electric field Em per unit mass of the mercury fill can be increased on the basis of the graph shown in FIG. 16 to thereby adjust the combination condition of Em and j for the optimum lamp lighting operation.

By monitoring the lamp voltage and keeping the lower-most point in temperature at a predetermined level from the lamp start-up time, the variation rate of the lamp voltage can be suppressed.

In the preferred embodiment, the double-pipe structure portion 42 may be provided with an ultrared-ray reflection film coated on a side part of the inner peripheral face of the outer wall 42*b*, corresponding to the location of each of the heating wires. By this arrangement, the control of the temperature increase can be effectively performed in the double-pipe structure portion 42.

It is noted here that, although a cylindrical shape of the double-pipe structure is used in this embodiment, it is not limited to this and other types of the structure such as oval, elliptical or spherical-like can be also used.

Referring to the effects of the present invention, an improved metal halide lamp can be provided to have a high luminous flux retention rate and high luminance of an arc discharge portion with a longer life of the lamp, suppressing a lamp voltage varying rate, avoiding a change in color temperature, which remarkably improves additional merits when in utilization as a light source in various display apparatuses such as optical projection systems.

In the construction of the present invention, a wide range of different metal halide materials to be sealed as well as different lamp powers can be adapted to fabricating metal halide lamps, and therefore the degree of freedom in fabrication of the design and efficiency in development thereof can be remarkably improved.

Moreover, in arranging a lamp-lighting circuit, since the securing range in applying the lamp voltage can be restricted, the fabrication in design of the lamp can be facilitated advantageously.

Although the present invention has been fully described by way of example with reference to the accompanying drawings, it is to be noted here that various changes and modifications will be apparent to those skilled in the art. Therefore, unless such changes and modifications otherwise depart from the scope of the present invention as defined by the appended claims, they should be construed as included therein.

What is claimed is:

1. A metal halide lamp which includes a discharge tube retaining a fill of mercury and at least one metal halide added as a luminous material in an inert gas atmosphere sealed therein, comprising:

a pair of discharge electrodes oppositely disposed with a space of a gap distance defining a length of an arc discharge portion produced between the paired discharge electrodes in the discharge tube, wherein an energy density of the arc discharge portion represented by a product E×j is in the range of $$70.0 \leq E \times j \leq 150.0 \ (VA/mm^3)$$

where E=V/d, j=I/S, assuming that I is a lamp current in amperes with a lamp voltage of V volts applied between the paired discharge electrodes in a stable lighting condition of the lamp and that each of the electrodes has a tip face of which a cut area in section is S $mm^2$ and the gap distance is d in millimeters.

2. The metal halide lamp as claimed in claim 1, wherein the discharge tube is made of a quartz glass, having a spherical-like inner bulb wall and each of the paired discharge electrodes is of a column-like shape which is integrally protruded from an electrode shaft inserted in a sealing member.

3. The metal halide lamp as claimed in claim 1, wherein a temperature mean value of an electrode tip portion of each electrode is within the range of 2300 to 2700 K.

4. The metal halide lamp as claimed in claim 3, wherein each of the discharge electrodes is formed with a diameter-varied portion between the tip face and a base portion thereof to have a varied area ($S_B$) in section different from the area ($S_A$) in section of the tip face of the protruded electrode.

5. The metal halide lamp as claimed in claim 4, wherein the diameter-varied portion is formed in an intermediate frontward portion of the protruded electrode.

6. The metal halide lamp as claimed in claim 5, wherein the diameter-varied portion is of a diameter-increased portion by providing an electrode coil member made of the same material as that of the electrode, which is wound by welding on the electrode.

7. The metal halide lamp as claimed in claim 5, wherein the diameter-varied portion is integrally formed with the protruded electrode portion by machining.

8. The metal halide lamp as claimed in claim 5, wherein an electrode tip portion of each electrode has a curved surface corresponding to a supporting part of the arc discharge portion.

9. The metal halide lamp as claimed in claim 1, wherein a relation between an electric field (Em) per unit mass of the mercury fill and the current density (j) is represented by a linear line having a certain inclination, and the current density (j) is restricted within a range represented by a formula:

$$j=30.5\times Em+a$$

where "a" is a parameter in the range of $-14.0 \leqq a \leqq -13.0$, and Em=V/d/m, and j=I/S.

10. The metal halide lamp as claimed in claim 9, wherein the mass (m) of the mercury fill sealed in the discharge tube is a fixed value which is used as a factor for optimizing the range of the current density j under application of a constant lamp power with a constant configuration in dimension of the discharge tube, having fixed values of the gap distance (d), while varying the diameter (ϕ) of the protruded electrode shaft with use of the same metal halide material sealed in the discharge tube.

11. The metal halide lamp as claimed in claim 10, wherein the diameter (ϕ) of the protruded electrode ranges from 0.98 to 1.12 mm under the fixed values of m=42 mg and d=3 mm.

12. The metal halide lamp as claimed in claim 10, which satisfies a specific correlation between a temperature (Tw) of the discharge bulb wall and the electric field (Em) per unit mass of the mercury fill whereby the electric field (Em) is varied in accordance with the temperature (Tw) with use of the fixed values of the lamp power under the condition of the fixed shape and dimension of the discharge tube having the fixed mass (m) of the mercury fill sealed therein.

13. The metal halide lamp as claimed in claim 10, wherein, in the correlation between the temperature (Tw) of the discharge bulb wall and the electric field (Em) per unit mass of the mercury fill, the electric field (Em) is increased by raising a temperature of a lower-most point of the discharge bulb wall.

14. A temperature control system for adjusting the temperature (Tw) of the discharge bulb wall of the metal halide lamp as claimed in claim 13, said system comprising:

a temperature control unit for adjusting the temperature (Tw) of the discharge bulb wall;

a lamp voltage detecting unit for detecting the lamp voltage applied to the metal halide lamp; and a calculation control unit for receiving a data signal of the lamp voltage value from the lamp voltage detecting unit, and judging whether or not lamp operating points are put on an optimum condition of the lamp, and then transmitting the resultant control signal of the calculation judgement to the temperature control unit for the temperature adjustment.

15. The temperature control system as claimed in claim 14, wherein the calculation control unit has previously stored data of the fixed values of the lamp power, gap distance, mass of the sealed mercury fill and area in section of the electrode tip portion, for thereby calculating the correlation between the temperature of the discharge bulb wall and the electric field per unit mass of the mercury fill, based on the stored data.

16. The temperature control system as claimed in claim 14, wherein the temperature control unit is comprised of a heating unit for heating the discharge bulb wall.

17. The temperature control system as claimed in claim 16, wherein the metal halide lamp is enclosed inside a double-pipe structure portion inserted through a pair of vertical walls, said double-pipe structure portion having cylindrical-like duplex inner and outer walls which contain a pair of heating wires inserted by winding at both side portions therein between the double-structure walls with a space having no provision of the heating wire at the intermediate portion therein.

18. The temperature control system as claimed in claim 17, wherein each of the heating wires is arranged in such a manner that the density of the windings thereof is increased inwardly from the vertical wall portion to the intermediate portion corresponding to the electrode base portion for effectively heating the discharge bulb wall.

19. The temperature control system as claimed in claim 17, wherein the temperature control unit adjusts the temperature (Tw) of the discharge bulb wall by controlling the supply of electric current to be applied to the heating wires flowing therethrough for heating.

20. The temperature control system as claimed in claim 17, wherein the double-pipe structure portion is provided with an ultrared-ray reflection film coated on both side parts of the inner peripheral face of the outer wall, corresponding to the location of each of the heating wires.

* * * * *